United States Patent [19]

Freeman

[11] 4,376,993

[45] Mar. 15, 1983

[54] ELECTRONIC WATCH WITH SEQUENTIAL READOUT AND CONTROL

[76] Inventor: Alfred B. Freeman, 2044 W. 12th St., Emporia, Kans. 66801

[21] Appl. No.: 177,230

[22] Filed: Aug. 11, 1980

Related U.S. Application Data

[63] Continuation of Ser. No. 854,524, Nov. 25, 1977, abandoned, which is a continuation of Ser. No. 731,629, Oct. 12, 1976, abandoned, which is a continuation of Ser. No. 478,690, Jun. 12, 1974, abandoned, which is a continuation-in-part of Ser. No. 397,589, Sep. 14, 1973, abandoned, which is a continuation of Ser. No. 246,910, Apr. 24, 1972, abandoned.

[51] Int. Cl.[3] ..... G04C 17/00; G04B 23/02; G04C 9/00

[52] U.S. Cl. ..... 368/69; 368/74; 368/188

[58] Field of Search ..... 368/29, 69–75, 368/87, 82–84, 159, 256, 239, 188, 187, 240–242; 235/92 T

[56] References Cited

U.S. PATENT DOCUMENTS

| | | | |
|---|---|---|---|
| 3,699,763 | 10/1972 | Zeph | 368/156 |
| 3,795,099 | 3/1974 | Tsuruishi | 368/112 |
| 3,834,152 | 9/1974 | Nishimura | 368/188 |
| 3,953,964 | 5/1976 | Suppa et al. | 368/224 |
| 3,969,886 | 7/1976 | Yoda | 368/73 |
| 3,992,871 | 11/1976 | Numabe | 368/187 |
| 4,067,187 | 1/1978 | Sekiya et al. | 368/188 |

*Primary Examiner*—Vit W. Miska

*Attorney, Agent, or Firm*—Dressler, Goldsmith, Shore, Sutker & Milnamow, Ltd.

[57] ABSTRACT

An electronic data storage and retrieval system, particularly embodied in an electronic watch instrument interrogated and controlled by a timed sequence of voltage pulses generated by the user's actuation of a switch or by his tapping or otherwise impacting an electroacoustic transducer such as a small earphone. For audible readout the instrument circuitry, when interrogated, drives the transducer to produce a coded sequence of tones easily learned by the user. The instrument may include an optical readout capability. Register means are provided for auxiliary data and for an alarm capability, and suitably coded user-produced voltage pulses serve to set a desired time in the alarm register, to arm or disarm the alarm, to read out the alarm time, to reset the basic time of the instrument, and to arm or disarm a periodic time readout.

59 Claims, 20 Drawing Figures

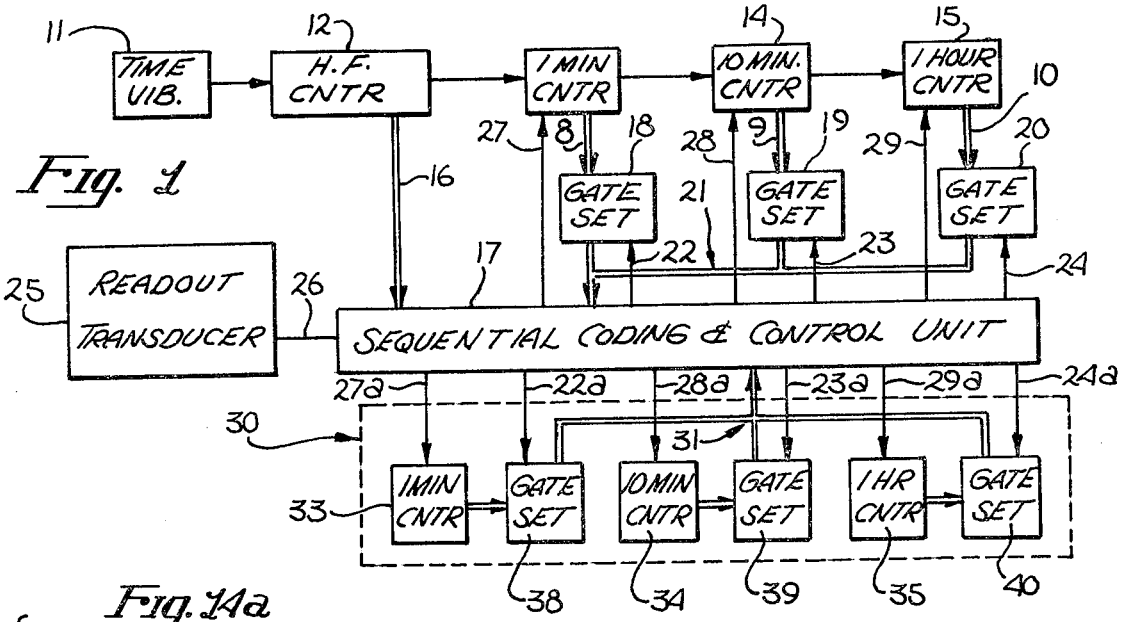
Fig. 1
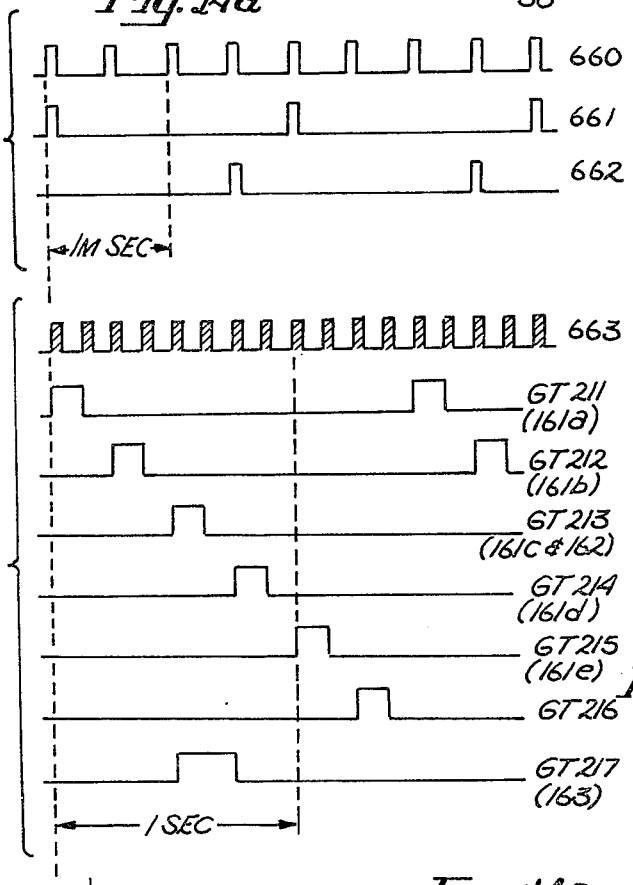
Fig. 14a
Fig. 14b
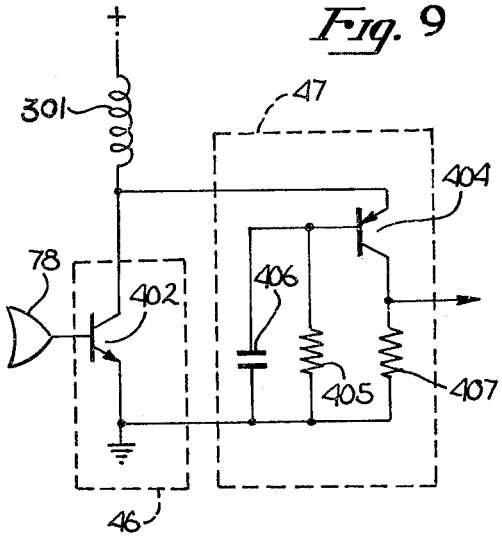
Fig. 9
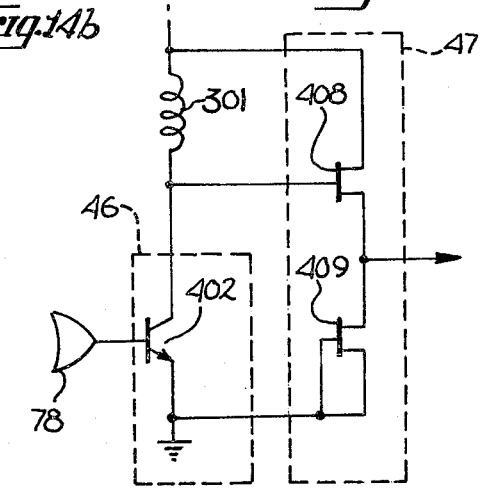
Fig. 10
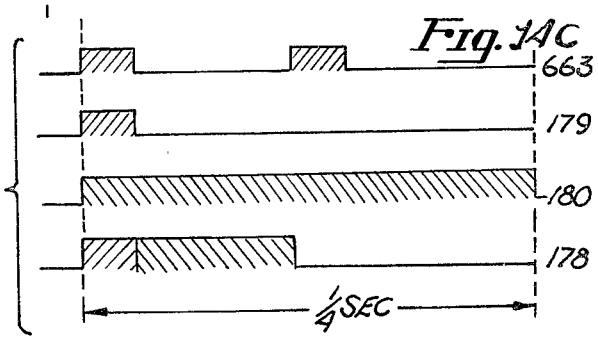
Fig. 14c

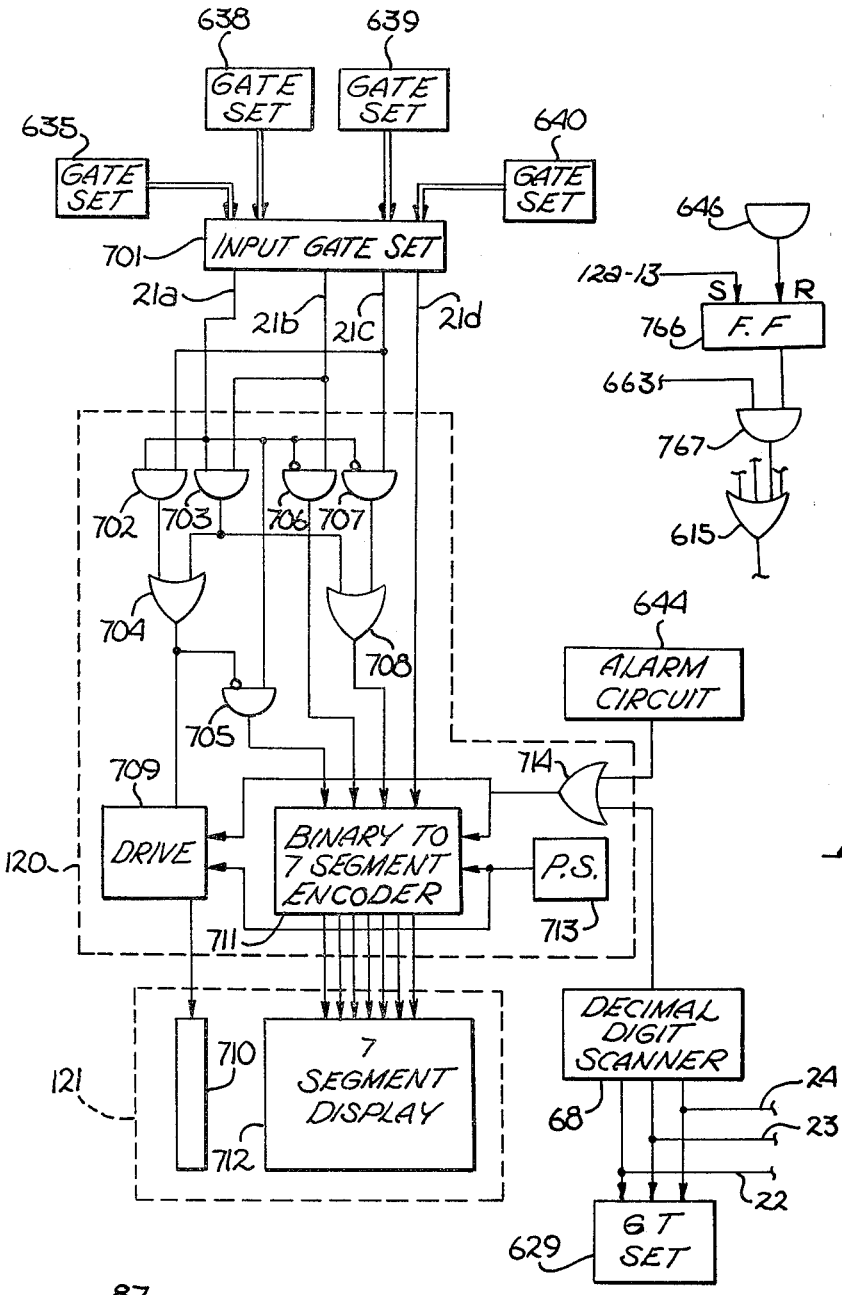
Fig. 16
Fig. 15
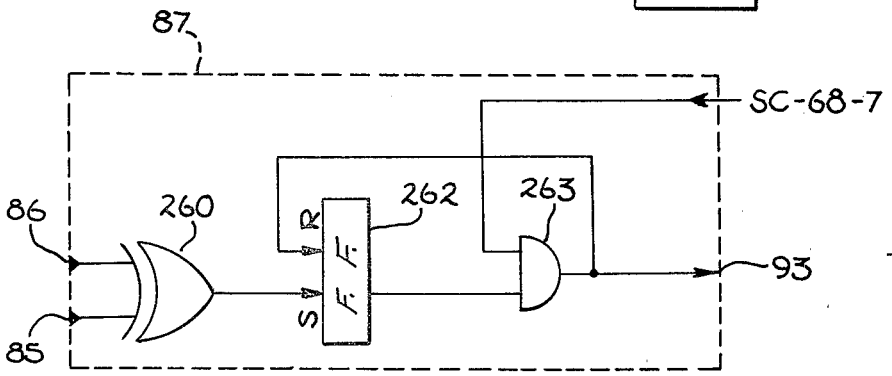
Fig. 7

CODE DIGIT SCANNER
BINARY CNTR
÷ 15
32,768 Hz
FROM

ELECTRONIC WATCH WITH SEQUENTIAL READOUT AND CONTROL

BACKGROUND AND SUMMARY OF THE INVENTION

This application is a continuation of application Ser. No. 854,524, filed Nov. 25, 1977, now abandoned, which was a continuation of application Ser. No. 731,629, filed Oct. 12, 1976, now abandoned, which was a continuation of application Ser. No. 478,690, filed June 12, 1974, now abandoned, which was a continuation-in-part of application Ser. No. 397,589, filed Sept. 14, 1973, now abandoned, which was a continuation of application Ser. No. 246,910, filed Apr. 24, 1972, now abandoned.

The present invention is directed to an electronic data storage and retrieval system particularly adapted as a watch instrument which represents the time and other parameters by a sequential readout which may be optical, or an audible code. The instrument responds to one or more interrogating or control voltage pulses, as generated by taps on its sound transducer or by actuation of a switch to initiate a readout and perform other control functions such as setting the time or alarm, and arming or disarming an alarm means and an hourly readout alert.

Present electronic watches use electric motors to position mechanical displays of the time, or optical display devices to present the time visually. Some of the latter devices are characterized by a comparatively large power consumption, and are turned on by a switch when the wearer wishes to know the time. Switches are typically bulky and unreliable, and so present a problem for electronic watches if they are required for the user to implement control functions such as the setting and arming of an alarm and requesting time readouts. Watches which include an alarm capability or optical displays are expensive and bulky. The bulk inhibits their use for ladies wrist watches, which are traditionally small and dainty.

The instrument of the present invention uses an inexpensive sound transducer, such as a small earphone used in a hearing aid or with a transistor radio or a dictating machine, to provide an audible representation of the time and other information, and to respond to a tap by producing one or more voltage pulses to initiate and control the readout. The sound transducer is not only low in cost and relatively light but is extremely rugged. Because the present watch with audible readout need not be seen, it can be worn as a brooch pinned near the shoulder or as a pendant suspended by a chain or other means around the neck and, however worn, it is particularly suited for use by the blind.

It is accordingly a principal object of the invention to disclose a novel system for providing a sequential control and readout of data when interrogated by the user. Additional objects are to disclose, in such an instrument, a transducer providing an audible readout of clock time and other information, and also capable, when tapped by the user's finger, of generating a voltage pulse constituting an interrogating signal to initiate the readout function and also a control signal for changing stored data; to disclose such an instrument having an alarm capability and means actuated by the tapping of a transducer for changing the alarm time; to disclose an electronic timekeeping device including means for setting or calibrating the device to a standard time signal; to disclose such an instrument capable of being manufactured very economically, and having low current drain on its energizing battery; to disclose such an instrument having means providing an hourly alert; and for other objects and purposes as will be understood from the following description of preferred embodiments of the invention, taken in connection with the accompanying drawings.

BRIEF DESCRIPTION OF THE DRAWINGS

FIG. 1 is a block diagram of the present invention.

FIG. 7 is a diagram of preferred circuitry for the comparator of FIG. 3.

FIG. 9 (with FIG. 1) is a schematic diagram of amplifiers using bipolar transistors and conventional components which can be used as the amplifiers associated with the electroacoustic transducer in the present invention.

FIG. 10 (with FIG. 1) is a schematic diagram of an alternative circuit using field effect transistors for the amplifier fed by the electroacoustic transducer in the present invention.

FIGS. 14*a*, 14*b*, and 14*c* (with FIG. 1) show waveforms at various points in the circuitry of FIG. 13.

FIG. 15 (with FIG. 7) shows a modification of the circuitry of FIG. 12 to provide an optical readout display of decimal digits.

FIG. 16 (with FIG. 7) shows a fragmentary portion of circuitry for modifying parts of the circuitry of FIG. 12 in order to produce an alerting signal each hour on the hour.

DETAILED DESCRIPTION

Figure 2:
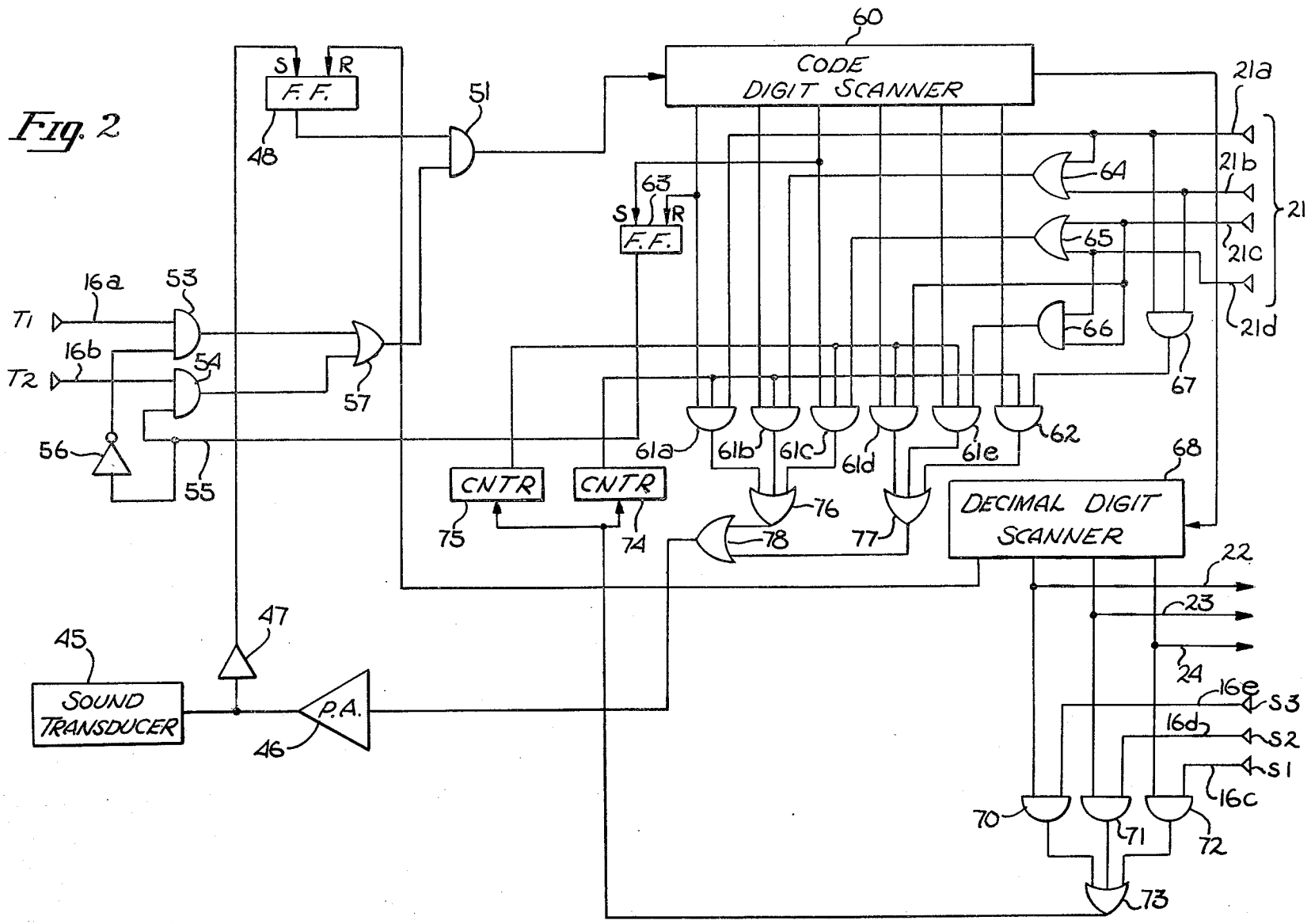
FIG. 2 is a circuit diagram showing details of the sequential coding and control unit of FIG. 1 for audible readout of the time.

Referring now to FIG. 1, time vibrator 11 is an accurate and stable frequency source, such as a quartz crystal oscillator, suitable as a reference source for an electronic watch. High frequency counter 12 divides the output frequency from time vibrator 11 down to one cycle per minute to drive the cascaded chain of counters 13, 14 and 15, which thus always register the actual time. Counter 13 registers the number of minutes from zero to nine, counter 14 registers the number of ten-minute intervals or "dekaminutes" from zero to five, and counter 15 registers the number of hours from one to twelve. Counter 12 also provides other output timing signals which are applied via cable 16 to sequential coding and control unit 17.

The outputs of counters 13, 14 and 15 representing the numbers registered are applied to gate sets 18, 19 and 20 respectively, whose outputs are connected to control unit 17 via cable 21. Under appropriate circumstances explained hereinafter, control unit 17 applies an enabling voltage to lines 24, 23 and 22 in turn to obtain the outputs from gate sets 20, 19 and 18 in turn to read the time. Control unit 17 converts each of the numbers represented by the outputs received from the gate sets to a coded form appropriate to drive readout transducer 25. Control unit 17 then applies signals in coded form for each number in turn to drive transducer 25 for a time readout.

In the form of the invention in which readout transducer 25 is a sound transducer, each number will be represented by an audible sequence of tones. Control unit 17 uses signals of selected frequencies from counter 12 in developing the signals to drive transducer 25 for production of the sequences of tones representing the numbers. In this form of the invention, transducer 25 may desirably take the form of a small electromagnetic earphone such as is used in hearing aids, transistor radios and dictating machines and shown in greater detail in FIG. 8. Such a transducer may then be used as a control device for requesting or interrogating a time readout and for implementing other functions, to be described below. Specifically, such a transducer is found to produce a large voltage pulse to a high impedance when subjected to a sudden mechanical shock such as by being tapped by the user's finger. Such a pulse has been found to have a magnitude several hundred times greater than the transducer's output signal from even very loud noises.

If readout transducer 25 is an optical display device, then control unit 17 energizes appropriate elements of the display to produce a representation of each number in the readout. Under these conditions control unit 17 will include an electroacoustic transducer as will be described in detail hereinafter, for the alarm function and for generating a voltage pulse upon being tapped by the user, for interrogating the apparatus and for performing other control functions of the instrument.

Means are provided in accordance with the invention for sounding an alarm at a selected time, including alarm register means for storing numbers corresponding to the selected time expressed in hours, dekaminutes and minutes. Such means are indicated generally at 30 in FIG. 1, and include counters 33, 34 and 35 for storing numbers of minutes, dekaminutes and hours respectively, thus constituting an alarm register similar to the time register provided by counters 13, 14 and 15. Gate sets 38, 39 and 40 receive the number representing outputs from counters 33, 34 and 35 respectively and apply their outputs to control unit 17 via cable 31.

As described in detail hereinafter, the voltage pulse generated by a single interrogating tap on the electroacoustic transducer causes control unit 17 to convert the numbers stored in counters 15, 14 and 13 to a sequential code for a readout of the actual time. Voltage pulses generated by two interrogating taps in quick succession on the transducer cause control unit 17 to convert the numbers stored in counters, 35, 34 and 33 to a sequential code for a readout of the time stored in the alarm register. During readout, the sequential code for each of the numbers is desirably separated from the code of the following number by a silent interval of a second or so, both to allow for recognition of the number and to permit the user to reset the number stored by appropriate taps during the silent interval. Thus, if the user wishes to change the time for which the alarm is set, he taps the transducer the appropriate number of times during the silent interval immediately following the readout of the number to be changed in the alarm register. More specifically, and assuming that the alarm is set for 6:30 and that the user wishes to change the alarm setting to 9:30, the following procedure applies:

A. The user taps the transducer twice in rapid succession, thus creating two succesive signals of relatively high voltage, which are impressed on control unit 17.

B. Control unit 17 then commences the readout of the time stored in the alarm register, starting with the number 6, corresponding to the number of hours recorded in counter 35, and feeds to the transducer the code for the number 6, followed by a silent interval of, say, one or two seconds. If the user does nothing during the silent interval, control unit 17 will then proceed to read out the number of dekaminutes stored in the ten-minute counter 34.

C. At the start of the silent interval, the user taps the transducer three times in rapid succession. Each tap generates a voltage pulse which causes control unit 17 to apply to counter 35, through line 29*a*, a signal advancing the number stored in counter 35 by one. Thus the three pulses generated by the three taps cause the number stored in counter 35 to advance from 6 to 9. A similar procedure applies in changing the numbers stored in the dekaminute and minute counters 34 and 33 respectively.

When the alarm is armed, in a manner to be described in connection with FIG. 3, control unit 17 performs a check each minute to find out if the two sets of numbers in the time and alarm registers are the same. When they are, then for a limited time of a few seconds, control unit 17 applies a series of signal bursts to transducer 25 to sound the alarm. The checks are made by applying the enabling voltage to pairs of lines 24 and 24*a*, 23 and 23*a* and 22 and 22*a* in turn. This gates the outputs of the respective pairs of hour counters 15 and 35, dekaminute counters 14 and 34, and minute counters 13 and 33 to control unit 17 for comparison in turn.

It will be readily understood that control unit 17 could also be made to respond distinctively to three taps in rapid succession or to other sequences of taps. These responses may include such other functions as turning the alarm on and off, selecting periodic readouts of the time, and setting the hour time counter 15, as would be necessary, for example, in traveling between time zones and in changing to or from daylight savings time. The dekaminute and minute time counters 14 and 13 could also be set, by the accuracy of electronic watches using quartz crystals has proved to be so high that there would be little need for changing such settings.

In FIG. 2 there are shown the details of circuitry in the coding and control unit 17 for reading out the actual or clock time registered in counters 13, 14 and 15. The readout consists of a series of tone bursts produced by sound transducer 45, which may be the electroacoustic transducer incorporated in control unit 17 mentioned above or, if readout transducer 25 is itself an electroacoustic transducer, then transducer 45 is the same as transducer 25.

When interrogated by the user by a tap on transducer 45, the circuitry of FIG. 2 provides means for producing a series of audible tone bursts which convey intelligence to the user as to the clock time. In the present illustrative embodiment of the invention, the tone bursts may be of two types, designated herein as "X" or "Y", which are distinguished from one another by one or more perceptually recognizable characteristics such as pitch, time duration or timbre. Additionally, the tone bursts for the hour, dekaminute and minute readouts may be further distinguished from one another by the pitch or pitches of the tone bursts. The user quickly learns the specific code employed, and an illustrative code will be described in detail below.

Figure 5A:
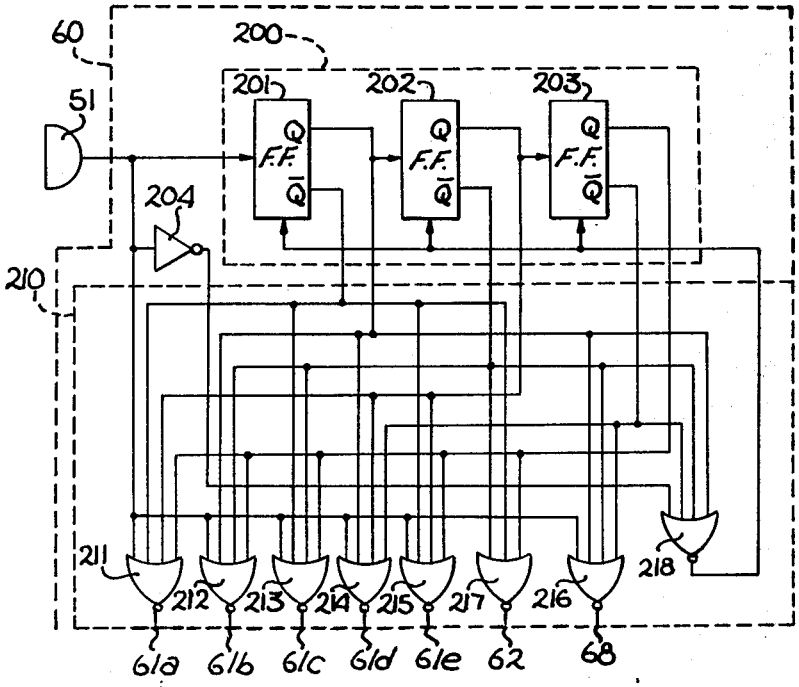
FIG. 5*a* is a diagram of preferred circuitry used as the code digit scanner of FIGS. 2, 3, 12 and 13.
Figure 5B:
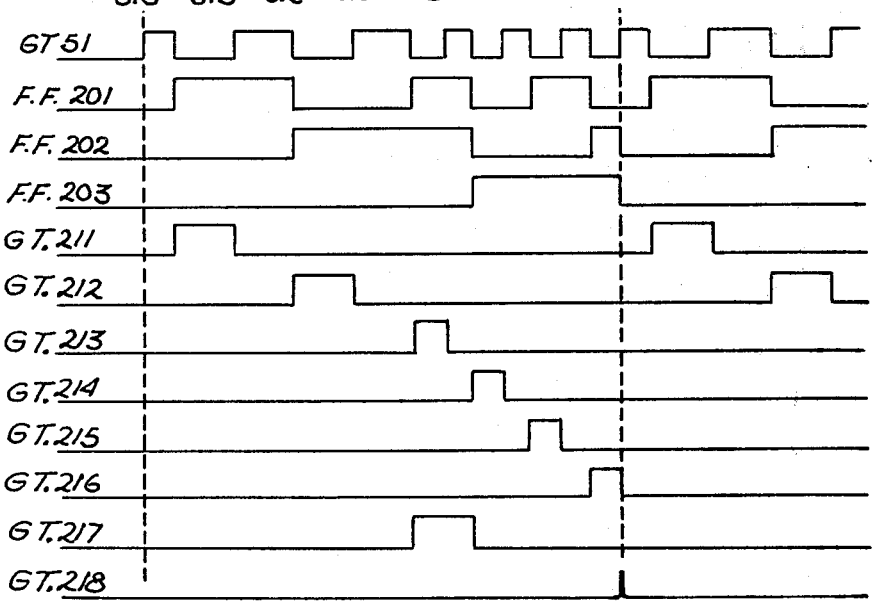
FIG. 5*b* shows the waveforms at several points in the circuit of FIG. 5*a* when used in the circuits of FIGS. 2 and 3.
Figure 6:
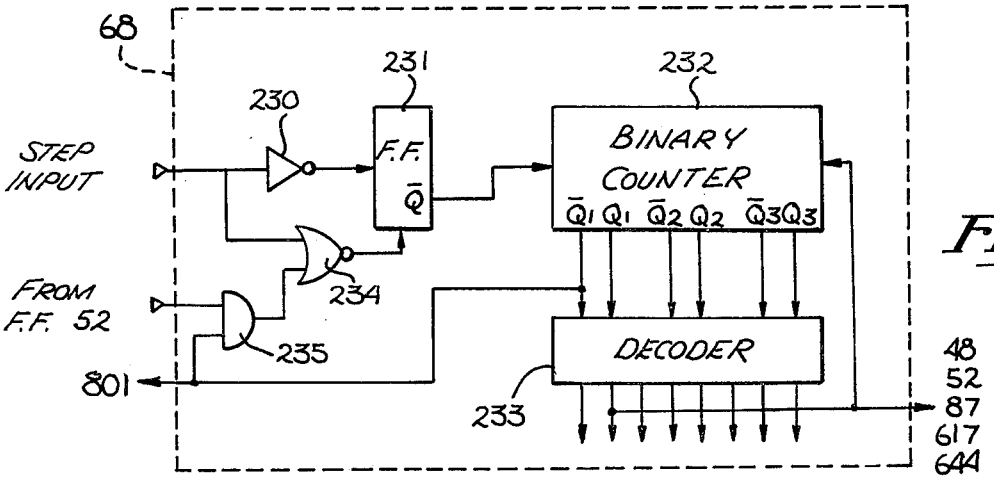
FIG. 6 is a diagram of preferred circuitry used as the decimal digit scanner of the circuits of FIGS. 2, 3, 4, 12 and 15.

The major components shown in FIG. 2 comprise code digit scanner 60 and decimal digit scanner 68, the former being further detailed in FIGS. 5*a* and 5*b*, and the latter in FIG. 6. Scanner 60 desirably includes twelve output positions, and scanner 68 includes eight output positions. Only alternate output positions of the scanners are active in the circuitry of FIG. 2, in order to provide silent intervals between successive numbers during readout. Thus the user will have sufficient time to understand a particular number read out before hearing the beginning of the readout for the next number, and will have enough time to tap in corrections for a number, if desired. Following is a functional summary of a time readout cycle of FIG. 2.

The apparatus of FIG. 2 performs these functions:

A. Triggering of the circuit into operation by an interrogating tap on transducer 45 which generates a voltage pulse large enough to drive amplifier 47, thus setting flip flop 48 and thereby enabling AND gate 51.

B. Stepping of code digit scanner 60 at a rate determined by one or the other of timing signals T1 or T2, depending on the setting of flip flop 63.

C. Sequential energizing of one of the inputs of each of AND gates 61*a–e* and 62, thereby preparing each gate to be enabled by binary coded clock time signal pulses on lines 21*a–d* and thus to pass a selected tone signal via OR gates 76, 77, 78 and amplifier 46 to transducer 45.

D. Stepping of decimal digit scanner 68 once during each cycle of scanner 60, selected steps of scanner 68 serving (1) to energize lines 24, 23, 22 whereby to enable respective gate sets 20, 19, 18 and thus to feed binary coded clock time signals to lines 21*a–d* and, synchronously therewith (2) to enable respective AND gates 72, 71, 70, whereby to pass the associated one of the tone signals S1, S2, S3 via frequency dividing counters 74, 75 to AND gates 61*a–e* and 62.

E. Disabling AND gate 51 by resetting flip flop 48 at the end of the cycle of scanner 68, thus terminating the flow of timing signals to scanner 60 and completing the cycle of operation.

Timing signals T1 and T2 on lines 16*a* and 16*b* as well as tone signals S1, S2 and S3 on lines 16*c–e* are produced by high frequency counter 12. Illustrative values of their frequencies are: T1, 4 Hz; T2, 8 Hz; S1, 2 kHz; S2, 4 kHz; and S3, 8 kHz. Frequency dividing counters 74 and 75, when used, produce output tones which correspond to different musical notes. Desirably one of the counters divides by an odd number, producing a different waveform, so that the two tones differ from one another not only as to pitch but also as to timbre. For example, counter 74 may divide by three and counter 75 by two.

As mentioned above, time duration of an output tone burst is one suitable criterion for distinguishing one type of tone burst from another type. For this reason the circuitry of FIG. 2 includes means for stepping scanner 60 at a different rate during one part of its cycle from its rate during the other part of its cycle. For example, since the user can easily distinguish a 2:1 ratio of tone burst time duration, the scanner may be stepped at a given relatively slow rate under the control of timing signal T1 while energizing gates 61*a* and 61*b*, and at double that rate under the control of timing signal T2 during the rest of its cycle. The scanner's dwell time at each of its positions will of course be inversely proportional to the stepping frequency being applied to it at the moment.

More particularly, when scanner 60 is stepped to its first active position where it supplies an energizing signal to prepare gate 61*a*, it simultaneously resets flip flop 63. This disables AND gate 54 and, via inverter 56, enables AND gate 53, so that timing signal T1 is applied to scanner 60 via OR gate 57 and AND gate 51, previously enabled by flip flop 48. Subsequently, when scanner 60 is stepped to its active position which energizes gate 61*c*, it simultaneously sets flip flop 63, thus supplying a signal on line 55 to enable gate 54 and disable gate 53, thereby substituting timing signal T2 in place of T1 for the rest of the cycle. In FIG. 5*b* this change of stepping frequency is seen in the waveform of the effective timing signal labeled GT 51. In the same Figure, the waveforms of NOR gates GT 211 and 212, controlling the respective gates 61*a* and 61*b*, are clearly seen to include dwell times twice as long as the dwell times of the waveforms of NOR gates GT 213, 214 and 215, which control gates 61*c*, 61*d* and 61*e* respectively. Also, in FIGS. 5*a* and 5*b*, it will be seen that NOR gate 217, which controls gate 62, has a dwell time equal in time duration to that of NOR gates 211 or 212, and commencing simultaneously with the dwell time of NOR gate 213, controlling gate 61*c*.

With continued reference to FIG. 2, the timing signal T2 via gate 51 first steps scanner 60 from its rest position to its position for which it applies a preparing voltage to gate 61*a* and, as previously explained, simultaneously substitutes timing signal T1 for T2 by resetting flip flop 63. Each successive half cycle of timing signal T1 or T2 steps scanner 60, and at successive alternate positions the scanner applies a preparing voltage sequentially to gates 61*b* through 61*e*. As previously mentioned in connection with FIGS. 5*a* and 5*b*, scanner 60 applies a preparing voltage to gate 62 for the same position for which such a voltage is applied to gate 61*c* and also during the immediately following position of the scanner. Finally, scanner 60 applies a stepping voltage to decimal digit scanner 68, and then is stepped to its rest position. With continued application of timing pulses T1 or T2, scanner 60 continues to be cycled through its positions, stepping scanner 68 at the end of each cycle. This process continues until scanner 68 reaches its next-to-last position, which resets flip flop 48 and thus disables gate 51, thereby terminating the cycling of scanner 60. Scanner 68 then steps itself one more position, and stops at its reset position.

Lines 21*a* through 21*d* constitute cable 21 onto which the number representations in counters 15, 14 and 13 are gated in turn as previously described. The representations are in binary form with line 21*d* carrying the lowest order digit, line 21*c* the next higher digit, line 21*b* the third higher digit, and line 21*a* the fourth higher digit. Line 21*a* goes directly to AND gate 61*a* and through OR gate 64 to AND gate 61*b*. Line 21*b* also goes through OR gate 64 to AND gate 61*b*. Lines 21*c* and 21*d* go through OR gate 65 to AND gate 61*c* and through AND gate 66 to AND gate 61*e*. Line 21*c* also goes directly to AND gate 61*d*. Lines 21*a* and 21*b* also go through AND gate 67 to AND gate 62.

AND gate 61*c* will be enabled by a "one" on either or both of lines 21*c* and 21*d*. AND gate 61*d* will be enabled by a "one" on line 21*c*, and AND gate 61*e* by a "one" on both of lines 21*c* and 21*d*. AND gate 61*a* is enabled by a "one" on line 21*a*, AND gate 61*b* by a "one" on line 21*a* or line 21*b*, and AND gate 62 by a "one" on both of lines 21*a* and 21*b*. When enabled by lines 21*a* through 21*d* and by scanner 60 as it passes each in turn, AND gates 61*a*, 61*b* and 62 cause an X type of sound to be produced, while, when enabled, AND gates 61*c*, 61*d* and 61*e* cause a Y type of sound to be produced.

The following table lists the numbers from one to twelve which may be represented, the state of lines 21*a* through 21*d* for each number, and the sequences of X and Y types of sounds which are produced for each number.

| Number | Code Table | | | | Gates Enabled | | | | |
|---|---|---|---|---|---|---|---|---|---|
| | 21a | 21b | 21c | 21d | 61a | 61b | 61c | 61d | 61e |
| 1 | 0 | 0 | 0 | 1 | | | X | | |
| 2 | 0 | 0 | 1 | 0 | | | X | X | |
| 3 | 0 | 0 | 1 | 1 | | | X | X | X |
| 4 | 0 | 1 | 0 | 0 | | Y | | | |
| 5 | 0 | 1 | 0 | 1 | | Y | X | | |
| 6 | 0 | 1 | 1 | 0 | | Y | X | X | |
| 7 | 0 | 1 | 1 | 1 | | Y | X | X | X |
| 8 | 1 | 0 | 0 | 0 | Y | Y | | | |
| 9 | 1 | 0 | 0 | 1 | Y | Y | X | | |
| 10 | 1 | 0 | 1 | 0 | Y | Y | X | X | |
| 11 | 1 | 0 | 1 | 1 | Y | Y | X | X | X |
| | | | | | | | 62 | | |
| 12 | 1 | 1 | 0 | 0 | Y | Y | Y | | |

It will be recognized that, in a sequence, each occurrence of the sound represented by an X in the preceding Code Table increases the number by one. Similarly, each occurrence of a Y increases the number by four. The number represented by a code sequence is then merely the sum of four times the number of fours corresponding to the number of times Y occurs in the sequence, plus the number of ones corresponding to the number of times X occurs in the sequence. This code can thus be simply and easily learned and it is not necessary to distinguish more than three occurrences of a particular sound in each sequence representing a number. It will further be recognized that many other code systems for audible presentations could be devised and implemented by similar apparatus.

As previously mentioned, at the end of the first cycle of scanner 60 following the setting of flip flop 48 by a tap on transducer 45, scanner 68 will be stepped to the position for which it applies a voltage to line 24 and simultaneously enables AND gate 72. The voltage on line 24 operates gate set 20 to apply the binary representation of the number of hours registered by counter 15 to lines 21*a* through 21*d*. Enabling of AND gate 72 causes it to pass the tone signal S1 via OR gate 73 to drive counters 74 and 75. Counters 74 and 75 divide the frequency of input signal S1 by different factors, so their outputs applied respectively to gates 61*a*, 61*b* and 62, and to gates 61*c*, 61*d* and 61*e* are different in frequency.

As scanner 60 steps through its positions on the next cycle, gates 61*a*, 61*b* and 62 will pass the tone signal from counter 74, and gates 61*c*, 61*d* and 61*e* will pass the tone signal from counter 75 during their respective intervals, if these gates are also enabled as a result of the voltages on lines 21*a* through 21*d*. The tone signal is then fed via one of OR gates 76 or 77 and via OR gate 78 to power amplifier 46 to drive sound transducer 45.

It will be recalled that the tone bursts associated with AND gates 61*a*, 61*b* and 62 will differ from those associated with AND gates 61*c*, 61*d* and 61*e* in pitch and timbre, and also will be twice as long in time duration. The differences in pitch and timbre are due to the different frequencies of the outputs of counters 74 and 75. The difference in time duration is due to the fact that scanner 60 holds the two sets enabled for different lengths of time during its cycle.

A sequential combination of Y and X sounds representing the number of hours registered by counter 15 according to the Code Table is thus produced during the cycle of scanner 60. Scanner 68 will then be stepped to its next position, which is an inactive position, for which no voltages will be applied to lines 21*a* through 21*d*. Scanner 60 will then cycle again without producing any tone bursts. Thus the user will have a period of time within which to understand the sequential code he has just heard. At the end of the cycle of scanner 60, scanner 68 will again be stepped to the position where it applies a voltage to the line 23 and to AND gate 71. Tone signal S2 from counter 12 via cable 16 is then gated to drive counters 74 and 75. The number registered by ten minute counter 14 is gated onto lines 21*a* through 21*d*.

The next cycle of scanner 60 then produces a sequential combination of tone bursts representing the number of dekaminutes registered by counter 14. Operation is the same as for the previous cycle for the hour readout, except that the pitches are different because tone signal S1 has been replaced by tone signal S2 to drive counters 74 and 75. The end of this cycle steps scanner 68 to another inactive position which does not cause voltages to be applied to lines 21*a* through 21*d*. Thus the following cycle of scanner 60 does not produce tone bursts, but again steps scanner 68.

Scanner 68 then applies a voltage to line 22 and to AND gate 70. A tone signal S3 on line 16*e* is applied to drive counters 74 and 75, and the number of minutes registered by counter 13 is applied to lines 21*a* through 21*d*. The next cycle of scanner 60 then produces a sequential combination of tone bursts representing the number of minutes registered by counter 13. At the end of that cycle, scanner 60 steps scanner 68 to another inactive position, and then cycles again before stepping scanner 68 to the position for which it resets flip flop 48, thus terminating the readout.

Tone bursts X and Y differ from one another in time duration, pitch and timbre. Also, the tone bursts for the hour, dekaminute and minute readouts differ among themselves in pitch. These differences are desirable in order to facilitate recognition and comprehension by the user, but not all the differences are essential. For example, the pitch differences among the hour, dekaminute and minute readouts could be forgone by using a single tone signal, say S1, instead of S1, S2 and S3. Such a single tone signal would be applied directly to counters 74, 75, thus eliminating gates 70–73. Alternatively, or in addition, the counters 74, 75 could themselves be eliminated. Under the latter condition the user would then be relegated to reliance solely on the time duration of the tone bursts, and their sequence, for comprehension.

Figure 3:
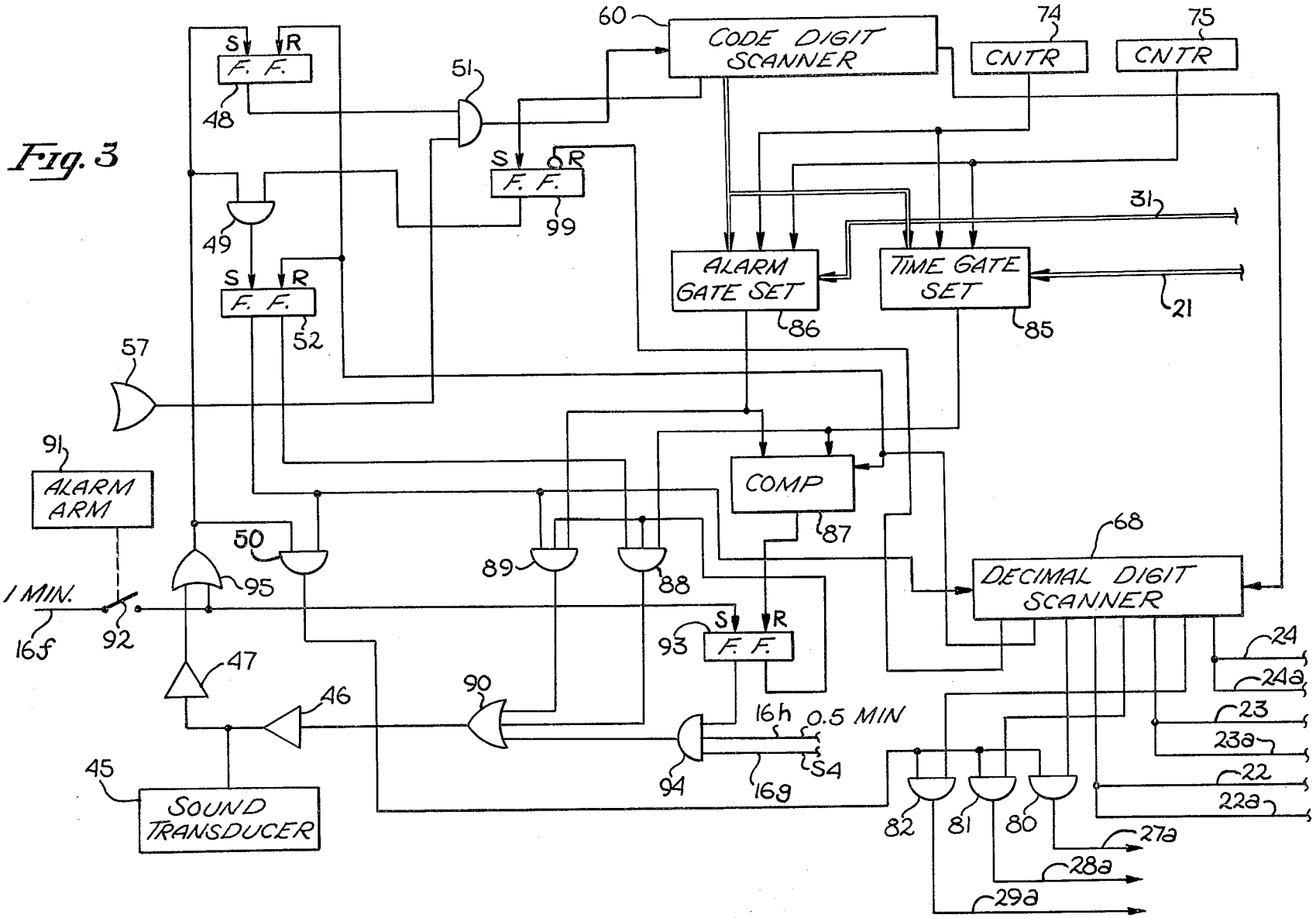
FIG. 3 is a circuit diagram showing details of the sequential coding and control unit of FIG. 1 which includes an alarm capability.

In FIG. 3 there is shown apparatus incorporating all of the apparatus of FIG. 2, and additionally including means providing an alarm capability, means by which the user can interrogate the apparatus to learn what time is set in the alarm counters, and means by which the user can change that setting. In the interest of clarity, certain components shown and described in connection with FIG. 2 are not repeated in the showing of FIG. 3, but the following description should be read with the understanding that such components are included in the actual operative circuitry. More specifically, such components include the subcircuit for selecting the timing signal T1 or T2 for driving the code digit scanner 60, comprising flip flop 63, gates 53–54, and inserter 56; and also the subcircuit comprising gates 70–73 for applying the selected tone signal S1, S2 or S3 to counters 74 and 75.

In FIG. 3, time gate set 85 is to be understood as being part of coding and control unit 17 and as including the following gates connected as shown in FIG. 2: 61*a*–61*e*, 62, 64–67, and 76–78. Alarm gate set 86 comprises similarly connected gates. During readout, alarm gate set 86 functions in a manner corresponding to that of time gate set 85 and, when the alarm is armed, functions synchronously therewith.

FIG. 3 may be functionally summarized as follows:

A. Clock Time Readout.

Flip flops 48, 52, 93 and 99 having been reset at the end of the preceding cycle of operation, and assuming that arm alarm switch 92 is open, an interrogating tap on transducer 45 creates a voltage pulse which initiates a clock time readout cycle identical to that of FIG. 2, by setting flip flop 48 and thus enabling gate 51 to pass timing control pulses T1 or T2 from gate 57 to step the code digit scanner 60. The resulting clock time readout fed to time gate set 85 by cable 21 applies bursts of tone signals from counters 74 and 75 to gate 88 (already enabled by the reset condition of flip flops 52 and 93) and thence via gate 90 to amplifier 46, driving transducer 45.

B. Alarm Setting Readout.

In order to learn what alarm time is stored in counters 33, 34 and 35 of FIG. 1, the user interrogates the system by tapping transducer 45 twice in rapid succession. The voltage pulse from the first tap initiates a readout cycle, as described in the preceding paragraph. As that cycle begins, the first active step of code digit scanner 60 sets flip flop 99, thereby enabling AND gate 49 to pass the voltage pulse from the second interrogating tap to set flip flop 52, thus disabling AND gate 88 and enabling AND gate 89. Setting of flip flop 52 performs additional functions also, to be explained later. The alarm setting readout cycle proceeds exactly as in the case of the clock time readout cycle, except that (1) since flip flop 52 has disabled gate 88 and enabled gate 89, the tone burst signals from alarm gate set 86, not those from time gate set 85, will be applied via OR gate 90 to drive transducer 45 through amplifier 46, and (2) as will be explained in connection with FIG. 6, setting of flip flop 52 applies a signal to decimal digit scanner 68 whereby the latter cycles only once for each two stepping inputs from scanner 60. Thus during readout of the alarm setting, the time intervals which separate the hour tone burst signals from the dekaminute tone burst signals, and which separate the latter from the minute tone burst signals, will be approximately twice as long as the corresponding intervals during readout of clock time. This not only helps the user to distinguish a readout of alarm setting from a readout of clock time, but also provides a longer interval within which the user can change the stored alarm setting, to be now explained.

C. Changing of Stored Alarm Setting.

During the alarm readout cycle, the first stepping of decimal digit scanner 68 energizes line 24*a* (and, irrelevantly, line 24), and thus causes gate set 40 of FIG. 1 to supply binary coded signals of the number of hours stored in counter 35 via cable 31 to alarm gate set 86, as previously described. The user thus hears the coded tone burst signals identifying the number of hours stored in hour alarm counter 35 of FIG. 1. The next position of scanner 68 enables AND gate 82, whose output goes via line 29*a* to counter 35. If the user wishes to change the hour alarm setting, he now taps transducer 45, and the voltage pulse resulting from each tap, via enabled gates 50 and 82, increases the setting of counter 35 by one. Similarly, after the dekaminute readout resulting from energizing line 23*a*, scanner 68 enables AND gate 81 for the corresponding purpose, and likewise for AND gate 80 after the minute readout.

D. Alarm Mode.

If the user wishes the system to sound an alarm at the time stored in alarm counters 33, 34 and 35, he actuates alarm arm 91 to close switch 92. A pulse from counter 12 via line 16*f* is then applied at one-minute intervals to set flip flop 93 thus enabling AND gate 94 and, via OR gate 95, to set flip flop 48, which initiates a cycle for synchronously reading out the time stored in both the alarm setting counters 33–35 and the clock time counters 13–15, and for comparing those two readouts in comparator 87. As will be later explained in connection with FIG. 7, if the two synchronous readouts are unequal, comparator 87 produces an output signal resetting flip flop 93 and thus disabling gate 94. However, if the two readouts are equal, the comparator does not produce an output signal, so flip flop 93 remains set and gate 94 remains enabled. Gate 94 is also fed by two signals derived from counter 12, namely an alarm tone signal S4 having a frequency of, say, 1500 Hz on line 16*g*, and a square wave signal on line 16*h*, the latter being timed to go from zero to the "one" level shortly after completion of the readout, and to remain at that level for a suitable period of time, say 0.5 minute. Thus the alarm tone signal will drive transducer 45 at the selected frequency for a selected time period. It may be noted that, by the time the next pulse arrives on line 16*f*, the clock time counter 13 will have advanced one minute, so comparator 87 no longer finds equality, resets flip flop 93 and hence no alarm is sounded.

As mentioned previously, the termination of the cycle of scanner 68 serves to reset flip flops 48, 52 and 99. More particularly, when scanner 68 is stepped to its seventh position, i.e. its position following that for which it enables gate 80, it applies a signal which resets flip flops 48 and 52. The same signal is also applied to comparator 87 for purposes to be described in connection with FIG. 7. Resetting of flip flop 48 disables gate 51 and thereby terminates the cycling of scanner 60. As described in connection with FIG. 2, scanner 68 then steps itself to its last or rest position and stops. The inverted signal from this last position is applied to the reset input of flip flop 99. Thus, flip flop 99 is held in reset condition except when scanner 68 is in its last position.

With further reference to the alarm mode of operation, it will be seen that, during the comparison readouts triggered by the pulses on line 16*f*, the user cannot obtain a readout of clock time or alarm setting by one or more interrogating taps on transducer 45. Under these conditions the user, not having received the beginning of a readout within, say, two or three seconds after interrogation, merely repeats his interrogation.

It will be seen that the output of amplifier 46, in addition to driving transducer 45, also is fed to the input of amplifier 47. The resulting output of the latter amplifier does not adversely affect the circuit in any way. Flip flop 48 is already in set condition. Gate 49 is enabled by the set condition of flip flop 99 only during the first cycle of scanner 60 which, it will be recalled, produces no output tone signals. At the end of that first cycle, scanner 60 applies a stepping pulse to scanner 68, thereby moving the latter from its rest position, thus resetting flip flop 99 and hence disabling gate 49 for the entire remaining portion of the readout cycle. Gate 50, even when enabled by the set condition of flip flop 52, has only one function—that of changing the numbers stored in alarm counters 33, 34 and 35 by applying tap-produced signals to gates 80, 81 and 82. But the latter gates are not enabled by scanner 68 during the time when output tone signals are being produced, and hence any amplified tone signal from gate 50 is merely applied to three disabled gates.

As will be discussed in greater detail in connection with FIGS. 9 and 10, amplifier 47 has a high input impedance and, when not being driven by a signal, the output of amplifier 46 also presents a high impedance to transducer 45. Thus, tap-generated voltage pulses from the transducer will not be appreciably attenuated. Amplifier 47 is arranged to respond only to voltages which are opposite in polarity from those which amplifier 46 supplies to the transducer in producing an output tone signal. Transducer 45 has its winding connected in the direction that makes the largest spike from a tap-generated pulse have the polarity to which amplifier 47 responds.

Figure 4:
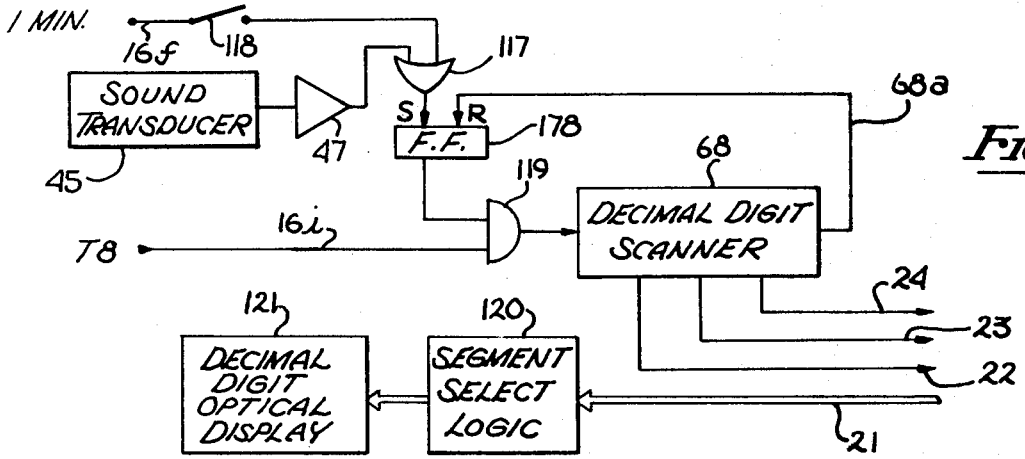
FIG. 4 is a circuit diagram showing details of an embodiment of the sequential coding and control unit of FIG. 1 for a sequential optical readout of the time.

In FIG. 4, supplemented by the showing of certain details in FIG. 15, there is shown an embodiment of the invention for sequentially optically displaying a readout of the time. The readout may be in response either to an interrogating tap by the user, or to a pulse recurring periodically, say one each minute. Readout is accomplished by the stepping of scanner 68 through its cycle, in a manner generally similar to that described in connection with scanner 68 of FIGS. 2 and 3. In FIG. 4 the stepping of scanner 68 is controlled by AND gate 119, which, when enabled by the set condition of flip flop 178, passes a square wave stepping signal T8 on line 16*a* of cable 16, having a frequency of the order of 1 Hz. Flip flop 178 will be set as a result of receiving a signal via OR gate 117 from either a tap-generated pulse from transducer 45 or, when switch 118 is closed, by a periodically recurring pulse of, say, once per minute from high frequency counter 12 on line 16*f*. As scanner 68 is stepped, it energizes lines 24, 23 and 22 in turn and thereby enables gate sets 20, 19, and 18 to apply the binary numbers in counters 15, 14 and 13 in turn to cable 21. Decimal digit scanner 68 next steps to a position for which it produces an output on line 68*a* to reset flip flop 178 and also an output to reset itself and thereby terminate the cycle.

As will be described in greater detail in connection with FIG. 15, segment select logic 120 receives the binary digits representing the number being gated out on cable 21 and converts the combination of binary digits to drives for a combination of display segments which will form the decimal digit represented by the binary combination. Decimal digit optical display 121 has the appropriate set of segments connected to the drive outputs of segment select logic and control 120. The segments which are driven are illuminated and thereby display the decimal digit represented by the binary combination applied to cable 21.

Decimal digits of zero through nine can adequately be displayed by different combinations of seven segments. An additional segment to depict the digit "one," located to the left of the seven segment array, obviously permits display of the numbers 10 through 19. Various displays of this type are available commercially and use any of a number of different elements to serve as the segments. Digital watches have been produced using light emitting diodes and liquid crystals to serve as segments. U.S. Pat. No. 3,672,155 discloses apparatus using the former and the article "C/MOS digital wristwatch features liquid crystal display" in the Apr. 10, 1972 issue of *Electronics* discusses the latter.

In FIG. 5*a* there is shown a preferred form of circuitry for code digit scanner 60, including two major components, a binary counter 200 and a decoder 210. The square wave timing signal T1 or T2 from gate 51 drives the first of three conventionally arranged flip flops 201, 202 and 203, and also drives inverter 204. The timing signal and the outputs of inverter 204 and of the three flip flops are fed through the combinations shown to NOR gates 211–218 of the decoder.

FIG. 5*b* shows the waveforms which appear at various points in the apparatus of FIG. 5*a* during a cycle of scanner 60. An unusual feature of this counter and decoder combination is that the frequency of the input signal to AND gate 51 changes during each cycle of binary counter 200. It will be recalled that this was caused by the setting and resetting of flip flop 63 as previously described in connection with the apparatus of FIG. 2. Each of NOR gates 211 through 218 has its output go positive for a different combination of input signals. The positive going outputs from NOR gates 211 through 216 occur one at a time in turn as counter 200 cycles. The outputs from NOR gates 211 and 212 last twice as long as those from NOR gates 213 through 216 because of the change in input frequency to AND gate 51.

The output of NOR gate 217 fed to gate 62 lasts twice as long as the output of any of NOR gates 213 through 216 because the combination of inputs it receives does not include one from AND gate 51 or inverter 204. The output of NOR gate 217 is the same length as that of each of NOR gates 211 and 212. The output of NOR gate 218 is applied to reset binary counter 200. Reset of the counter 200 changes the input combination to gate 218 and so terminates its output after a very short interval, as indicated in its spike waveform in FIG. 5*b*.

FIG. 6 shows a preferred embodiment of the decimal digit scanner 68. It receives its stepping signal during audible readouts from gate 216 (FIG. 5*a*), and during visible readouts from gate 119 (FIG. 4), but, as will be described in connection with the periodic alarm check of the apparatus of FIG. 12, scanner 68 receives a high frequency stepping signal directly from counter 12 during such alarm checks.

When the input of the stepping signal goes positive, the output of inverter 230 will go negative and will toggle the flip flop 231 to its other position. During a time readout, AND gate 235 is not enabled by flip flop 52, so the output of NOR gate 234 will go positive when the input goes negative and will reset flip flop 231. Thus, while gate 235 is disabled, flip flop 231 will follow the step input signal. The output of flip flop 231 is applied to drive binary counter 232 which is similar in important respects to binary counter 200 of FIG. 5, having three stages and hence a total of eight different positions. Decoder 233 receives the outputs of binary counter 232 and, in a manner well known in the art, energizes a corresponding one of its eight outputs for each position. The outputs from decoder 233 occur one at a time one after the other instead of being spaced apart as were the outputs of decoder 210.

The output of decoder 233 which corresponds to the seventh active position of scanner 68 is applied back to reset binary counter 232. Moreover, this same output not only resets flip flops 48 and 52 but also performs certain functions, described hereinafter, in comparator 87 and in the circuitry of FIGS. 12 and 13. If flip flop 52 is in its set condition, as in a readout of the stored alarm setting, AND gate 235 is thereby enabled. One of the outputs of the first stage of binary counter 232 is applied to gate 235, so that gate will then produce a positive output to NOR gate 234 while binary counter 232 is in its alternate positions. That positive input to NOR gate 234 holds its output negative, so it will not reset flip flop 231. A second stepping input signal is then necessary in order to toggle flip flop 231 back to its set condition and thereby resume the cycle of counter 232. Thus counter 232 remains in one set of alternate positions twice as long as in the other set of alternate positions. This is desirable, it will be recalled, in order to provide the user lengthened time to change the alarm setting of FIG. 3. The same output from the first stage of counter 232 is fed to line 801, for purposes to be described in connection with FIG. 12. Inverter 230, flip flop 231, OR gate 234, and AND gate 235 are not needed in the apparatus of FIG. 2.

FIG. 7 shows a preferred embodiment of the comparator 87 of FIG. 3. The outputs of time gate set 85 and alarm gate set 86 are applied to the inputs of EXCLUSIVE OR gate 260, which produces an output only when its two inputs are different. Flip flop 262 will be set by an output from gate 260 and will then enable AND gate 263. The output from the seventh position of decimal digit scanner 68 will then pass through AND gate 263 to reset flip flop 93, and also to reset flip flop 262 within the comparator. Gate 260 and flip flop 262 will be made to have slower response times than the circuits of gate sets 85 and 86 so that they will not respond to transients resulting from small differences in the response times of the gate set circuits. Stated another way, such transients must not be able to set flip flop 262.

Figure 8:
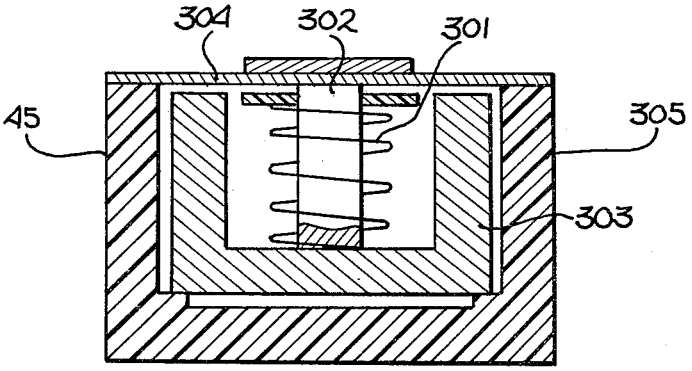
FIG. 8 (with FIG. 6) is a sectional view of a typical electroacoustic transducer which can be used with the present invention.

As shown in FIG. 8, the audible transducer 45 is of a type that is used in a standard hearing aid. The transducer includes a coil 301 wound around a permanent magnet element 302. One end of the magnetic element 302 is mounted in the center of a cup 303 of magnetic material mounted in a plastic case 305. A diaphragm 304 of magnetic material is mounted across the other end of the magnetic element 302 and the open circumference of the cup 303. The center of the diaphragm 304 may touch the end of element 302 but is held a short distance away from the lips of cup 303 by its contact with case 305. The magnetic attraction holds diaphragm 304 in place and pulled toward the lips of cup 303.

A current through coil 301 adds or subtracts from the magnetic field of element 302 and so changes the force on diaphragm 304. Diaphragm 304 is of a resilient material so its deflection varies with the force applied. Variation of force with current thus causes a corresponding displacement of diaphragm 304. The apparatus thus produces sounds corresponding to the current oscillations applied. These transducers are capable of producing signals which are easily heard over a range of several feet.

Diaphragm 304 may consist of a thin disc reinforced over a center range so that it has an appropriate resonant frequency and range of movement. For use in a watch, the resonance could be enhanced for greater efficiency over a limited frequency range. The plastic case enclosing the apparatus can also enclose the integrated circuit chip or be part of the case enclosing it.

When the case is tapped with the finger, relatively high G forces are applied to the diaphragm 304. The resulting deflection changes the flux in the magnetic circuit and induces a large voltage in coil 301. The voltage induced is many times larger than that which would be produced by very loud sounds as the forces on the diaphragm are very much greater. The differences are of more than two orders of magnitude or by a factor of several hundred.

The coil 301 of the earphone used should have a relatively low impedance for two reasons. One is that the size and cost would increase with the number of turns for a high impedance and the other is that the voltage required to drive it would also increase. A low impedance, such as is found in earphones commercially on the market, can be driven from a 1.5 volt battery so the same supply used for the watch can also be used for the amplifier driving the earphone. A driving current of several milliamperes is desirable to produce a sufficiently loud sound from a transducer of this type.

While a sufficient drive current might be obtained from MOS or CMOS stages, a considerable chip area would be required. It may be more economical to use a single low cost high gain bipolar transistor to drive coil 301 with peak currents of from 10 to 50 milliamperes. As required by hearing aid transducers, a MOS or CMOS stage can easily provide sufficient drive for the bipolar transistor which would have a current gain of over a hundred. To conserve power, the bipolar transistor will be biased off except when driven on by a signal. The tone signals used will be pulses which drive the transistor on only during a small fraction of each cycle. The collector of the bipolar transistor will represent a substantially open circuit to the coil 301 when not being driven. Voltages induced by taps on the transducer will thus not be attenuated.

Figure 12:
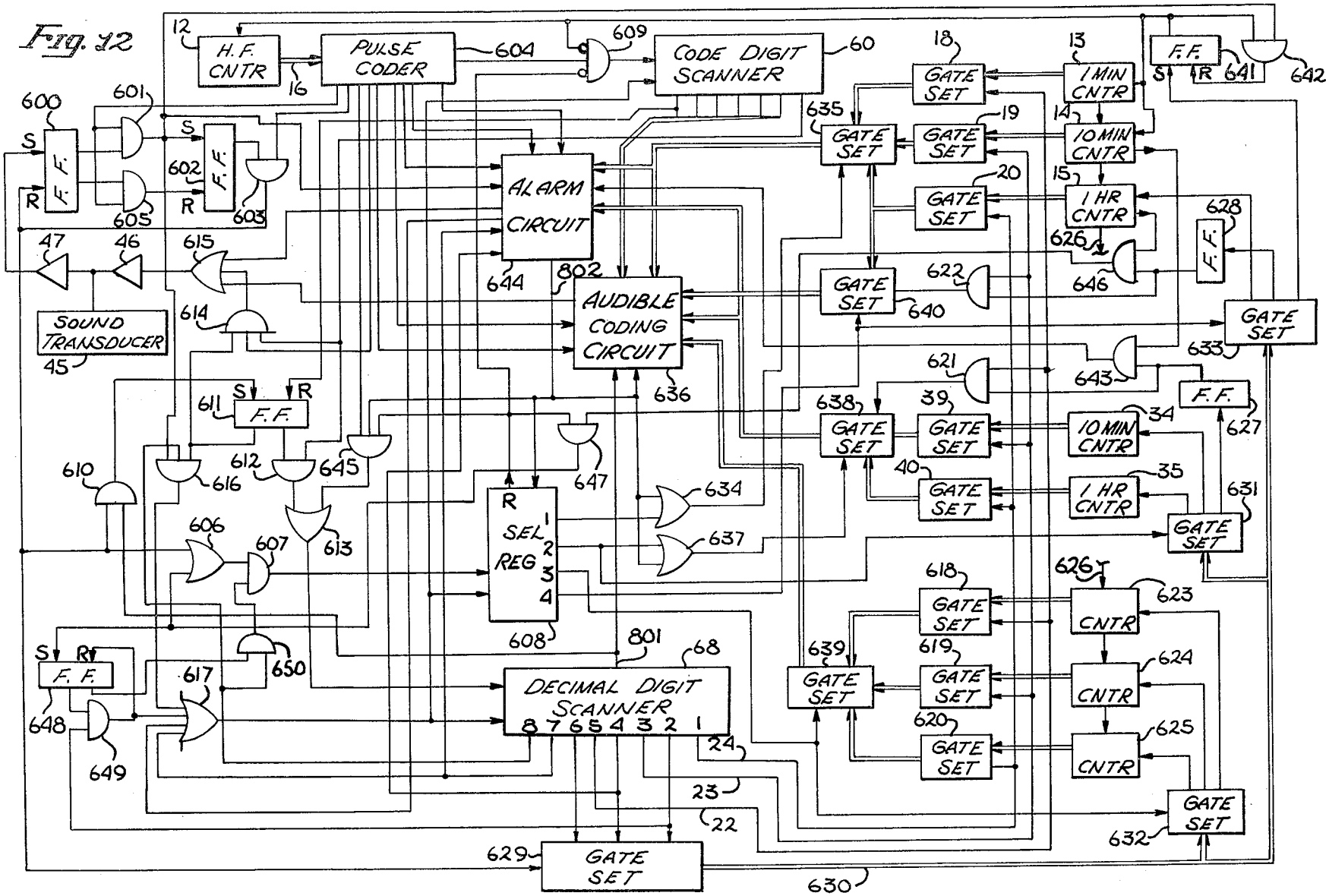
FIG. 12 is a diagram of another embodiment of the sequential coding and control unit of FIG. 1, which includes capability for additional functions.

FIGS. 9 and 10 are embodiments of the amplifier circuits 46 and 47 of FIG. 2 which could also be used in the apparatus of FIGS. 3, 4 and 12. The coil 301 of transducer 45 connects a positive potential source to the collector of bipolar NPN transistor 402. Transistor 402 is held in the deactivated state by OR gate 78 except when its output goes to the "one" state. When OR gate 78 is switched to the "one" state, current is passed into the base of transistor 402 to cause it to produce the desired current through coil 301. OR gate 90 and OR gate 617 in the apparatus of FIGS. 3 and 12 respectively, would provide the same type of drive.

Transistor 402 is thus the primary element of amplifier 46. Low cost silicon transistors can furnish the necessary collector current peaks which may range from 10 to 50 milliamperes depending upon the design parameters of transducer 45. The impedance of coil 301 for all designs will be sufficiently low to allow the supply to be a single cell battery. A high gain low cost silicon transistor would require less than a half milliampere base drive which can easily be furnished by MOS or CMOS devices.

In FIG. 9, the junction of coil 301 with the collector of transistor 402 is also connected to the emitter of bipolar NPN transistor 404. The parallel combination of resistor 405 and capacitor 406 connect between the base of transistor 404 and ground. Resistor 407 connects between the collector of transistor 404 and ground. Resistor 405 is very large, of the order of several megohms, so that transistor 404 conducts only slightly in the steady state condition. The voltage on its collector is then substantially at ground potential.

When transistor 402 conducts, it lowers the voltage on the emitter of transistor 404. This only serves to further reduce the conduction through transistor 404. The time constant of capacitor 406 and resistor 405 is long so voltage on the base of transistor 404 does not change appreciably during the conduction intervals for transistor 402. When a tap on transducer 45 induces a voltage in coil 301 driving the emitter of transistor 404 positive, transistor 404 draws base current from capacitor 406, conducts, and pulls the voltage on its collector positive. As the voltage across capacitor 406 only changes as it provides charge, it effectively holds the base of transistor 404 at a fixed potential for the first increment of time, so transistor 404 functions as a grounded base amplifier. With capacitor 406 charged more positive by the first positive half cycle of the tap-generated pulse, transistor 404 will not conduct on subsequent cycles. Thus the possibility is eliminated that the ringing trains of a single tap-generated pulse might cause more than one stepping signal to be applied, which would erroneously set flip flop 52. Resistor 407 will be sized to produce an appropriate response to the output from a tap, but not to the much smaller outputs from noises.

Transistor 404, capacitor 406, and resistors 405 and 407 thus serve as amplifier 47 producing positive voltage outputs in response to tape on transducer 45. FIG. 10 shows an alternative embodiment for amplifier 47 which can be implemented on the same chip as the rest of the watch circuitry. The junction of coil 301 and the collector of transistor 402 connects to the gate of a P channel FET device 408. The source of device 408 is connected to the positive potential source and its drain to the source of FET device 409. Device 409 has its gate and drain connected to ground. Devices 408 and 409 comprise the embodiment of amplifier 47.

Devices 408 and 409 may both be depletion mode devices which are fully conducting when their gates and sources are at the same potential. Device 408 will then be driven out of conduction when a more positive voltage from coil 301 resulting from a tap on transducer 45 is applied to its gate. The parameters of devices 408 and 409 would be such that the voltage at their junction would remain near the positive source potential until the conduction through device 408 was reduced by the more positive voltage on its gate. The voltage would then go negative and could either serve as the output or later be inverted.

Device 408 might also be an enhancement mode device. The logic of the apparatus of FIGS. 2, 3, 4, and 12 is such that amplifier 47 can respond to outputs of amplifier 46 without adversely affecting the system. Device 408 would then not be caused to conduct until the voltage on its gate was pulled negative by the conduction of transistor 402 or by the voltage induced across coil 301 by a tap on transducer 45. It will be recognized that both positive and negative voltages are induced across coil 301 by taps. The polarity could be reversed simply by reversing the connections to coil 301. Device 409 would remain a depletion mode device.

With reference to power consumption for readouts, it may be noted that a sound transducer, such as that of FIG. 8, can be driven by signals such as those shown in FIGS. 14*a* and 14*c* by the circuits of FIGS. 9 and 10. Transistor 402 of FIGS. 9 and 10 will have a voltage drop of the order of tenths of a volt for peak currents required to drive the coil 301 of the sound transducer. A 1.5 volt single cell battery will provide enough voltage for the drop across the transducer coil 301 and the bipolar transistor 402. A battery such as the "EVER-READY" No. 357 Cell made by Union Carbide Corporation can supply the voltage and peak currents required by the cheapest hearing aid earphones to produce sound of adequate loudness.

The amount of current required to produce a given deflection of the diaphragm per cycle can be reduced by reducing the duty cycle during which transistor 402 is turned on. The waveforms of FIG. 14*a* consist of 1/16 millisecond pulses occurring at rates of approximately 2 kHz and 500 Hz. The X type sounds shown in FIG. 14*c* consist of a 32 millisecond burst of the 2 kHz pulses so that transistor 402 would be conducting for 4 milliseconds for each X sound. The Y sound of FIG. 14*c* consists of an X sound followed by 500 Hz pulses for another 96 milliseconds, so the on time for transistor 402 for a Y sound is 7 milliseconds. The on time for transistor 402 is then 36 milliseconds.

An on time for transistor 402 of 2 seconds per day would allow more than twenty readouts and assorted alarms. Yearly on time would then be 12 minutes for the audible readouts and a peak current of 50 milliamperes would consume 10 milliampere hours or 15 milliwatt hours. The capacity of the battery is of the order of 180 to 190 milliampere hours, so only a small proportion of the battery's capacity is needed for audible readouts and alarms to be reasonably expected during a year.

Figure 11:
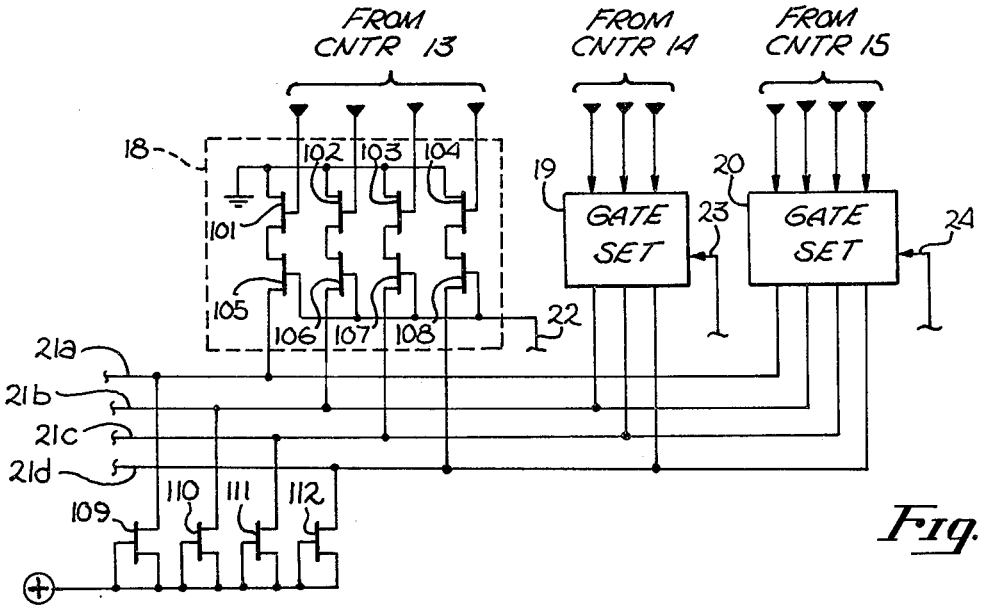
FIG. 11 (with FIG. 6) is a partial schematic and partial block diagram of preferred circuitry for certain of the gate sets of the present invention.

FIG. 11 shows gate sets 18, 19, and 20 receiving inputs on four, three and four lines from counters 13, 14, and 15 respectively. Each input represents a "one" or a "zero" for a corresponding binary digit by an appropriate potential. The binary digits for 8, 4, 2, and 1 from counter 13 are applied to the gates of field effect transistors 101, 102, 103, and 104 respectively in gate set 18. FETs 105, 106, 107, and 108 of gate set 18 have their gates connected to line 22 and their sources to the drains of FETs 101, 102, 103, and 104 respectively. The drains of FETs 105 through 108 connect to lines 21*a* through 21*d* respectively and the sources of FETs 101–104 connect to ground.

When line 22 is at a potential which causes FETs 105–108 to be conductive, a conductive path to ground will be provided for those of lines 21*a* through 21*d* whose associated FET 101–104 are made conductive by the input received from counter 13. The potential on lines 23 and 24 will be such that no conductive paths will be provided through the corresponding circuits in gate sets 19 and 20. The number in counter 13 is thus represented by the ones of lines 21*a* through 21*d* having conductive paths to ground. The numbers in counters 14 and 15 will be similarly represented when lines 23 and 24 respectively have the appropriate potential applied in turn.

Sequential coding and control unit 17 will respond to the combinations of conductive paths to produce audible or optical representations of the numbers. Sequential coding and control unit 17 may first convert the conductive states into different potentials by having each of lines 21*a* through 21*d* connected to a potential source through a resistance much higher than that of the conductive paths. Such resistances could be provided by low conductive FETs 109–112 having drains connect to lines 21*a*–21*d* respectively and gates and sources to a source of potential.

The embodiment of FIG. 12 performs additional functions not included in the embodiments of FIGS. 2 and 3, and also performs some of the same functions in a different way. As in FIGS. 2 and 3, once during each cycle of code digit scanner 60, it generates a pulse signal for stepping the decimal digit scanner 68, and the latter functions in a manner similar to that of FIGS. 2 and 3 in producing a readout of clock time and of the stored alarm setting, and in permitting the user to change the latter. However, several differences in operation from FIGS. 2 and 3 should be initially noted generally. Specific circuit elements for accomplishing those differences will be described later. First, the rate at which scanner 60 is stepped remains constant throughout a particular cycle; the different time durations of output tone signals X and Y are provided by other means in the circuitry of FIG. 12. Secondly, in order to minimize current drain and down time of the apparatus caused by periodic alarm checks, means are provided for stepping scanner 68 at a much higher rate during such periodic checks than during readouts. Thirdly, not every cycle of scanner 60 causes stepping of scanner 68: when flip flop 611 is in its set condition, the thus disabled gate 612 prevents a stepping pulse generated by scanner 60 from reaching scanner 68.

Figures 13, 17:
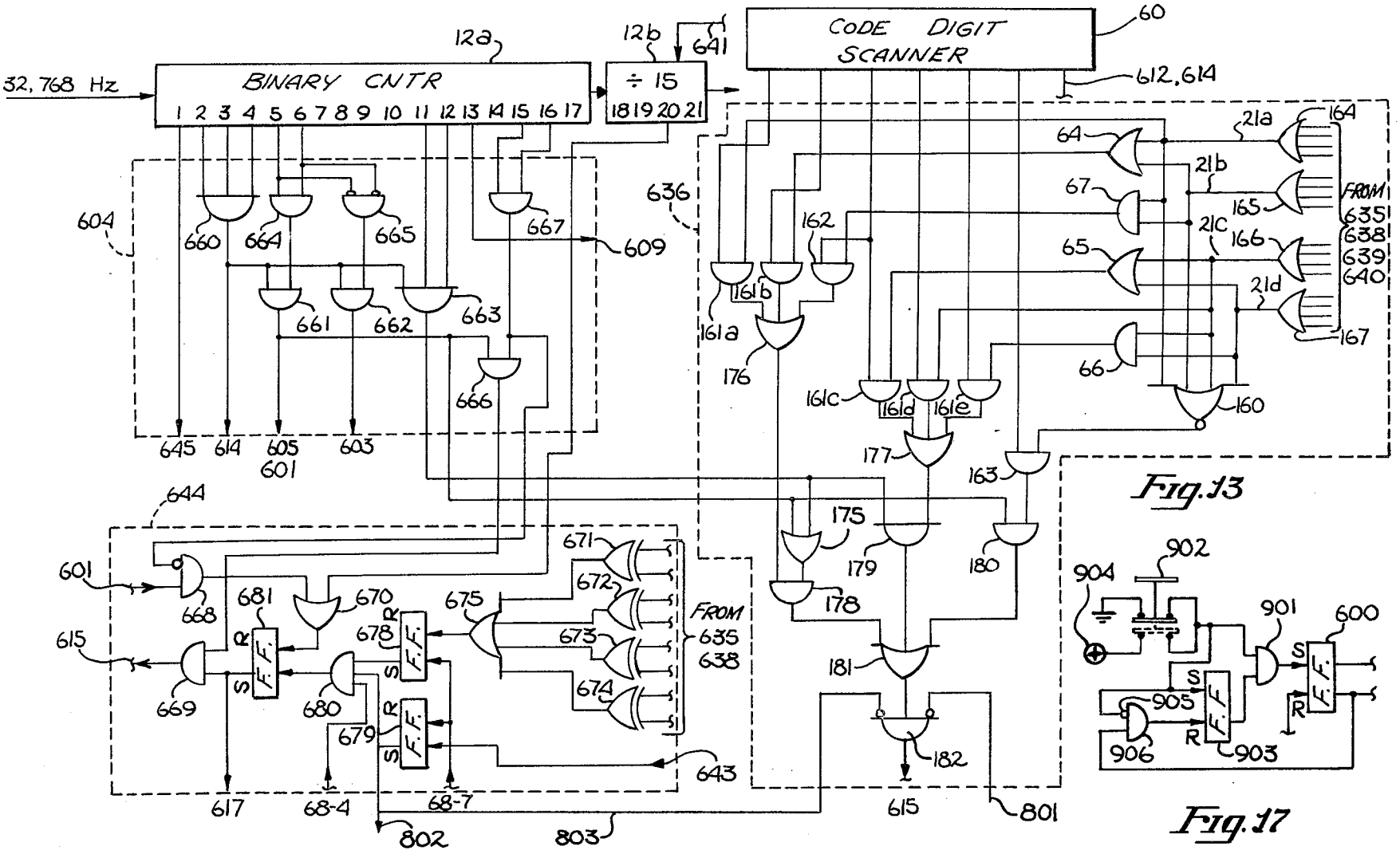
FIG. 13 is a detailed logic diagram of major portions of the circuitry of FIG. 12.
FIG. 17 (with FIG. 13) shows a subcircuit by which the user may apply interrogation and/or control pulses to the apparatus by a push button or similar switch.

The FIG. 12 apparatus includes three major components shown in block form, pulse coder 604, audible coding circuit 636 and alarm circuit 644, whose detailed internal circuitry is shown in FIG. 13. Reference to that circuitry, as well as to waveforms thereof shown in FIGS. 14*a, b* and *c*, will be made from time to time in the following description of the operation of FIG. 12. The apparatus also includes an additional major component, selection register 608, having in the present illustrative form of the invention a total of four active positions to provide four functional outputs, a selected one of which may be energized by the user's tapping transducer 45 the proper number of times during predetermined time periods, as will be described hereinafter.

More particularly, the output from the first active position of selection register 608 energizes gate set 635 via gate 634, to provide a time readout of the clock time in counters 13, 14 and 15, in a manner similar to the clock time readout heretofore described in connection with FIGS. 2 and 3.

The output of the second active position of selection register 608 controls the several alarm functions of the present circuitry. As a result of two suitably timed taps by the user on transducer 45, in a manner to be described in detail hereinafter, selection register 608 is stepped to its second position, in which it directly energizes gate set 631 and, via gate 637, energizes gate set 638. Thereafter, cycling of code digit scanner 60 steps decimal digit scanner 68 through its cycle for an alarm readout. Such readout is generally similar to that previously described in connection with FIG. 3, except for certain differences. First, it is assumed that an alarm setting accurate to within ten minutes is satisfactory for the user's purposes. Consequently, it will be noted that alarm minute counter 33 of FIG. 3 is not included in the circuitry of FIG. 12. Secondly, means are provided for informing the user, by a tone signal, whether or not the alarm function is armed and, during the immediately following step of scanner 68, for affording the user an opportunity to change the armed characteristic, either from armed to disarmed, or from disarmed to armed, by a tap on transducer 45. When armed, the system makes an alarm check every ten minutes. Comparator means in alarm circuit 644 performs similarly to comparator 87 of FIG. 3, sounding the alarm when clock time becomes equal to the stored alarm setting.

The third active position of selection register 608 provides a signal for reading out information stored in counters 623, 624, and 625. These counters may have stored therein any desired information which changes chronologically, such as the date and month, phase of the moon, signs of the zodiac or the like.

The fourth active position of selection register 608 provides a signal to gate sets 633 and 640, and the immediately following cycle of scanner 68 performs several functions relating to clock time. These include: (A) Providing the user with the ability to change the clock time hour stored in counter 15, as when traveling between time zones or when starting or ending daylight savings time; (B) providing the user a choice as to whether he wishes an automatic hourly time readout on the hour either in the form of the appropriate combination of X and Y tone signals or, to be described in connection with FIG. 16, in the form of simply a short tone burst, under the assumption that the user knows which hour it is; and (C) permitting the user to set the clock time of the watch by comparison with an acknowledged standard, such as the hourly beep signals broadcast by station WWV in Washington, D.C. This technique, in accordance with the invention, consists generally of resetting to zero the numbers stored in minute and dekaminute counters 13 and 14, and setting the number stored in hour counter 15 to the next hour. The user then waits for the arrival of the standard signal for the next hour, such as the beep just mentioned. Upon hearing the beep, the user immediately taps transducer 45, which causes the present watch to commence operation.

Thus, the functions performed by the several positions of selection register 608 may be summarized as follows:

| POSITION | FUNCTION |
|---|---|
| 1 | Clock time readout |
| 2 | Readout and change of alarm setting and of alarm arm/disarm mode |
| 3 | Special data readout and change |
| 4 | Clock time hour change; arm/disarm of hourly alert; and calibration to standard |

After completion of the cycle of any of the several modes of operation, resetting means are energized by which to reset code digit scanner 60, decimal digit scanner 68 and selection register 608, so that the system returns to its quiescent state, prepared to receive one or more interrogating taps by the user. The quiescent state is further characterized by the following conditions of the indicated circuit elements in FIGS. 12 and 13: Flip flops 600, 602, 641, 648, 679 and 681 are reset; flip flop 678 is set; and flip flops 611, 627 and 628, for reasons later appearing, may be either set or reset in the quiescent state.

It will be noted that the reset position of selection register 608 provides an output which, inverted, is applied to AND gate 609, thereby disabling it and preventing pulse coder 604 from applying stepping signals to code digit scanner 60. It is accordingly apparent that, in order to commence the stepping of scanner 60, it is first necessary to step selection register 608 from its reset position to its first active position.

Means may be provided to insure that, in the user's interrogating or controlling the system by one or more taps on transducer 45, the circuit does not interpret the ringing trains of the first tap-generated signal as a signal generated by a second tap. In the present illustrative embodiment of the invention, such means include the subcircuit comprising AND gates 601, 603 and 605 and flip flops 600 and 602, together with means including lines from AND gates 661 and 662 (see FIG. 13) of pulse coder 604, whereby gate 661 enables gates 601 and 605 during a time period spaced in phase from the period during which gate 662 enables gate 603. Thus, as shown by the waveforms of gates 661 and 662 in FIG. 14*a*, gate 662 never enables gate 603 when gate 661 enables gates 601 and 605. As will now be explained, this arrangement provides a delay until the ringing trains from the original signal are no longer of sufficient amplitude to produce a second response.

Sound transducer 45, power amplifier 46 and amplifier 47 function as in the apparatus of FIGS. 2 and 3. In order to initiate operation of the circuit of FIG. 12, the user taps transducer 45 whose output, amplified at 47, sets flip flop 600, thus enabling AND gate 601. The next pulse from pulse coder 604 applied to enabled gate 601 sets flip flop 602, thus enabling gate 603. The subsequent signal to that enabled gate from pulse coder 604 not only resets flip flop 600 but is also applied to gate set 629 for purposes later appearing, and, in order to initiate a cycle of the system, serves to step selection register 608 via OR gate 606 and AND gate 607. It will be noted that the latter gate is enabled by AND gate 650, itself enabled by the reset condition of flip flop 648 and the reset position of scanner 68.

Resetting of flip flop 600 disables gate 601 and enables gate 605. When enabled gate 605 receives the next pulse from pulse coder 604, that pulse resets flip flop 602 and thus disables gate 603.

It will be seen that the components of the subcircuit just described have now been returned to their quiescent condition, prepared to receive another tap-generated pulse for setting flip flop 600 and thereby producing another pulse from AND gate 603 for again stepping selection register 608. The time delay arising from the cycling of the subcircuit serves to prevent any possibility that the ringing trains from the first tap-generated pulse might, if amplifier 47 does not otherwise suppress the ringing, cause the subcircuit to produce a second stepping pulse fed to selection register 608. In this connection, it will be seen that it is important that the output of AND gate 601 be turned off before the output of AND gate 603 turns on. This is assured because each pulse from pulse coder 604 to gates 601 and 605 is spaced from the pulse from pulse coder 604 which is applied to gate 603.

As selection register 608 is thus stepped from its reset position to its first active position, it enables AND gate 609 so that timing signal pulses from pulse coder 604 are passed through, thus commencing the stepping of code digit scanner 60. AND gate 610 is held enabled while decimal digit scanner 68 is in its reset position and its other even numbered positions by an output signal on line 801, identified in FIG. 6. Hence, the first pulse from AND gate 603 passes through gate 610 to set flip flop 611. When scanner 60 reaches its first active position, it produces an output which resets flip flop 611. As will be seen, flip flop 611 will remain in its reset condition, holding gate 612 enabled, unless, during the remaining part of the cycle of scanner 60, flip flop 611 receives a second tap-generated pulse via enabled gates 603 and 610. Since the time period of a cycle of scanner 60 is of the order of a second or two, the user has that time period within which, if he wishes, to tap transducer 45. The user learns that the time period has ended by hearing a short tone burst from transducer 45. The burst is produced at gate 660 (see FIGS. 13 and 14*a*) of pulse coder 604, and is applied to AND gate 614, already prepared by reason of the set condition of flip flop 611, and enabled when scanner 60 reaches its last active position. As will be seen, the output of gate 614 is fed via OR gate 615 and amplifier 46 to the transducer.

If the user does not tap the transducer during the first cycle of scanner 60, scanner 60 continues through its cycle, and its last active position steps scanner 68 to its first active position by applying a stepping pulse via enabled gate 612 and gate 613 to scanner 68. This stepping of scanner 68 from its reset position 8 disables AND gate 650, and thereby AND gate 607, so selection register 608 cannot be stepped from its first active position until scanner 68 returns to its reset position 8 at the end of its readout cycle. That cycle accordingly proceeds, reading out the clock time of counters 15, 14 and 13 by sequentially energizing lines 24, 23 and 22 at positions 1, 3 and 5 of scanner 68, exactly as in the apparatus of FIG. 2. It may be noted that the second, fourth and sixth positions of scanner 68 are applied to gate set 629, which may consist of an arrangement such as gates 80, 81 and 82 of FIG. 3. As in FIG. 2, the second, fourth and sixth positions of scanner 68 are inactive during a readout of clock time, and serve primarily to give the user a period of time within which to comprehend the coded readout signal he has just heard. When scanner 68 reaches its seventh active position, it resets alarm circuit 644 and, via OR gate 617, resets itself, selection register 608 and scanner 60, thus restoring the circuit to its quiescent condition.

The above description has assumed that the user did not tap transducer 45 during the first cycle of scanner 60. On the other hand, if the user does tap the transducer during the one or two second time period before scanner 60 reaches its last active position, the pulse so generated serves to step selection register 608 to its second active position, and simultaneously to prevent the last active position of scanner 60 from applying a stepping signal to scanner 68. More particularly, the second tap-generated pulse steps selection register 608 via gate 606 and enabled gate 607; and it prevents stepping of scanner 68 by applying a setting signal to flip flop 611, thereby disabling gate 612.

Under these conditions, with selection register 608 at its second active position and scanner 68 remaining on its eighth or reset position, scanner 60 commences its second scanning cycle, the first active position of which resets flip flop 611. As previously described with reference to the first cycle of scanner 60, the user again has a time period of a second or two within which to tap transducer 45 and thereby step selection register 608 to its third active position. As before, the termination of the time period of a second or two while scanner 60 is cycling is communicated to the user by a short signal tone burst energized by the last active position of scanner 60, enabling gate 614. Assuming that selection register 608 has thus been advanced to its third active position, the user will again have an opportunity during the third scanning cycle of scanner 60 again to tap transducer 45 and thus to step selection register 608 to its fourth active position. If the selection register has been so stepped by the fourth tap by the user, then the user again has the option, during the fourth cycle of scanner 60, of tapping the transducer for the fifth time, which would step selection register 608 to its reset position, thus stopping scanner 60 by disabling gate 609, thereby restoring the entire circuit to its quiescent condition.

Security means are provided to minimize and virtually eliminate the possibility that accidental taps on transducer 45 might adversely affect the setting of the alarm or the clock time of the present watch. One such accidental tap, as by the user's inadvertently striking his watch on a hard object, would at worst trigger an unwanted readout of clock time, terminating in a return of all components to quiescent condition. A second such accidental tap, occurring within the less than two second cycle time of scanner 60, would as above described be interpreted by the apparatus as calling for a readout of the stored alarm setting. It is true that one or more accidental taps during the readout of alarm setting might change the stored alarm setting, or change the arm/disarm alarm mode, but such taps could do so only if they occur during specific narrowly limited time intervals, which is highly unlikely in the case of accidental taps occurring at random times. It is much more unlikely that random accidental taps might affect the actual clock time of the watch, since that function is available for change by the user only when selection register 608 has been stepped to its fourth active position by four taps accurately spaced in time, as described above.

An additional security means is provided to minimize the possibility that accidental random taps might adversely affect the setting of any of the functions of the watch. This additional security means includes a subcircuit by which the occurrence of two taps during any one cycle of scanner 60 before it begins to step scanner 68 immediately aborts the operation and restores the apparatus to its quiescent condition.

More particularly, the subcircuit of the additional security means includes AND gate 616, whose output, when enabled, is fed via OR gate 617 to reset scanners 60 and 68 and selection register 608. The output of the eighth or reset position of scanner 68 prepares gate 616, and the gate is enabled by the set condition of flip flop 611. It will be recalled that this is the situation existing after the user, having interrogated the system by a first tap, then taps again before scanner 60 reaches its last active position of its first cycle. If, under these conditions, a third tap is made, the resulting output of gate 601, when enabled by a pulse from pulse coder 604, will be applied to enabled gate 616, whose output, via gate 617, resets the system as above described. So long as scanner 68 remains in its eighth or reset position, the same resetting of the system will result from two tap-generated pulses occurring while scanner 60 is between its first and its last active positions.

The apparatus of the present invention is further protected against the possibility of being adversely affected by accidental taps by reason of the tone bursts themselves which the apparatus produces in response to one or more interrogating taps. Thus, even if the user is not aware of the accidental tap itself, the resulting tone burst signals from the apparatus would alert the user so that he could prevent additional accidental taps.

Details of the clock time readout will now be described, including reference to the internal circuitry of audible coding circuit 636 as shown in FIG. 13, and the waveforms of FIG. 14*b*. The output of the thirteenth stage of binary counter 12*a* is fed to AND gate 609, and when that gate is enabled, serves to step code digit scanner 60 through its cycle. During that cycle, scanner 60 provides outputs to AND gates 161*a–e*, whose waveforms are shown on the indicated lines of FIG. 15*b*. AND gate 162 receives the same output from scanner 60 as does gate 161*c*, and gate 163 receives the output shown in the last line of FIG. 14*b*. It will be recognized that these waveforms differ from the corresponding waveforms of FIG. 5*b* only in the fact that the frequency of the input stepping signal fed to scanner 60 remains constant in the embodiment of the invention shown in FIG. 12, instead of being changed during the cycle, as in the case of FIGS. 2 and 3. Otherwise stated, the circuitry of FIG. 5*a*, with gate 609 being substituted for gate 51, will produce the outputs shown in FIG. 14*b*.

AND gates 161*a*, 161*b* and 162 are associated with the production of Y type signals, as were gates 61*a*, 61*b* and 62 of FIG. 2. Gates 161*c–e* are associated with the production of X type signals, as were gates 61*c–e* of FIG. 2. AND gate 163 is associated with the production of a sound to represent the number "zero," which was not done in the apparatus of FIG. 2. The other inputs to gates 161*a–e* and 162 come from OR gates 64, 65, AND gates 66, 67, and lines 21*a* and 21*c*, in the same arrangement as the corresponding gates in FIG. 2. AND gate 163 receives its other input from NOR gate 160, which receives inputs from lines 21*a*, 21*b*, 21*c* and 21*d*. OR gates 164, 165, 166 and 167 each receives the output for its corresponding binary digit from gate sets 635, 638, 639 and 640 of FIG. 12. Lines 21*a*, 21*b*, 21*c* and 21*d* are connected to the outputs of OR gates 164, 165, 166 and 167 respectively. AND gate 163 will be enabled via NOR gate 160 when all of lines 21*a*, 21*b*, 21*c* and 21*d* are at the "zero" level. Gates 161 and 162 will be enabled in combinations for the various binary number inputs appearing on lines 21*a–d*, as were the corresponding gates 61*a–e* and 62 of FIG. 2, in order to produce the Y and X sounds as shown in the code table set forth hereinabove.

It will be recalled that in the embodiments of FIGS. 2 and 3, the tone signals from counters 74 and 75 were fed to the inputs of gates 61*a–e* and 62. However, in the embodiment of FIGS. 12 and 13 the corresponding gates 161*a–e* and 162 do not themselves receive tone signals, but instead tone signals are fed to AND gates 178 and 179, which are enabled via OR gates 176 and 177 respectively by signals from the two groups of gates 161*a* and *b* and 162, and 161*c–e*. Thus, the output of gate 661 of pulse coder 604 is fed to OR gate 175 and to AND gate 180, the latter being enableable by AND gate 163, which it will be recalled is associated with the control of the tone signal for "zero." The tone signal from gate 663 of pulse coder 604 is applied via gate 175 to AND gate 178, and to gate 180. Gates 178, 179 and 180, when enabled by gates 176, 177 and 163 respectively, pass the respective tone signals via OR gate 181 to AND gate 182, which, when enabled, passes such tone signal or signals via gate 615 and amplifier 46 to transducer 45. Gate 182 is enabled via line 801 when scanner 68 is in its odd numbered positions and, from line 803, when alarm circuit 644 is not engaged in an alarm check.

Each X output tone signal has a frequency of approximately 2 kHz and lasts for approximately 1/32nd second, as will now be explained. Thus, gate 179 receives the tone signal output of gate 663 and passes such tone signal each time gate 179 is enabled by an output from any of gates 161*c, d* or *e*, via gate 177. The tone pulse bursts from gate 663 are shown on the first lines of FIGS. 14*b* and 14*c*, and are there seen to be short, high pitched sounds, similar to the corresponding sounds produced in the apparatus of FIGS. 2 and 3. However, it will be noted that the shortening of the X sound is produced by gate 663 in the FIG. 12 embodiment, rather than by change of the stepping rate of scanner 60, as in FIGS. 2 and 3. It will also be noted in FIG. 14*b* that the pulse bursts will commence with the start of each output from scanner 60.

In producing the signal for "zero," gate 180 receives from gate 661 a signal output having a frequency of approximately 500 Hz. When enabled by the ¼th second output of scanner 60 via gate 163, gate 180 passes that 500 Hz signal via gate 181 to gate 182. The waveforms of the outputs of gates 179 and 180 are shown on the respective lines of FIG. 14*c*, with the waveform of gate 179 being crosshatched to represent a tone frequency of 2 kHz, and the waveform of 180 being crosshatched to represent a tone signal of 500 Hz. Thus, for example, the output of gate 179 shown in FIG. 14*c* is that which would be obtained for a "one" on line 21*d*, enabling gate 161*e*.

Each Y sound, as indicated by the waveform of gate 178 in FIG. 14*c*, includes a tone signal at a frequency of approximately 2 kHz for the first 1/32nd of a second, followed by a tone signal of approximately 500 Hz frequency for the remainder of the ⅛th second total time duration of the signal. Thus, gate 178 receives, via OR gate 175, the approximately 2 kHz and 500 Hz outputs of gates 663 and 661 respectively. Each time gate 178 is enabled for ⅛th second by the output of gate 176, it produces the signal shown in its waveform, being a combination of two different pitches and accordingly quite distinctive from both the X sound and the "zero" sound in character as well as in duration and pitch.

In summary, audible coding circuit 636 resembles generally the corresponding apparatus in FIGS. 2 and 3, but incorporates distinctive features as just described.

As previously mentioned, the user can request a readout of the alarm setting. Such readout, as will be now explained, includes not only a readout of the numbers stored in the alarm hour counter 35 and the alarm dekaminute counter 34, but also a tone signal informing the user as to whether the alarm mode of the instrument is armed or disarmed. Moreover, as was true in the embodiment of FIG. 3, the user is provided an opportunity, during the alarm readout, for changing the alarm setting by tapping the transducer the appropriate number of times during the intervals following the hour and dekaminute readouts. In the embodiment of the invention shown in FIG. 12, the user may also, during the interval following the signal indicating whether the alarm mode is armed or disarmed, change that condition to the other condition. These alarm readout functions will now be described in detail.

It is assumed that the user has initially interrogated the circuit by a tap on transducer 45, in order to step selection register to its first active position, and to commence the first cycle of scanner 60. Thereafter, before scanner 60 reaches its last active position of its first cycle, the user again steps selection register by a tap on transducer 45, so that the selection register is in its second active position. Under these conditions, it enables gate sets 631 and 638, so that those gate sets will pass the signals subsequently to be received during the cycling of decimal digit scanner 68. Thus, when scanner 68 is in its first position, it applies a signal to line 24 which enables gate set 40 to feed to gate set 638 the number stored in the alarm hour counter 35. Gate set 638, having been enabled by the second active position of selection register 608, passes those signals to audible coding circuit 636, and more particularly to gates 164–167, as previously described in connection with the time readout. Audible coding circuit 636 then produces an audible representation of the number stored in alarm hour counter 35, again exactly as was done during the time readout previously described. Scanner 60 then steps scanner 68 to its second active position, which passes a signal through enabled gate 629 and cable 630 to gate set 631. If the user then taps transducer 45, the resulting output signal of gate 603 will pass through gate sets 629 and 631, and will step counter 35. Each tap will not only advance the number stored in counter 35 by one, but will also, via enabled gate 610, set flip flop 611. This serves to disable gate 612, so that another complete cycle of scanner 60 must occur in order to reset flip flop 611 and thereby permit scanner 60 to supply a stepping signal to scanner 68. Thus, the user will have enough time to advance the number stored in counter 35 by as many steps as he wishes.

When the user stops tapping transducer 45, or if he does not tap the transducer at all, scanner 60 will supply a stepping pulse signal to scanner 68, moving the latter to its third active position. At that position, the scanner applies a pulse signal via line 23 to enable gate set 39, which then feeds the number stored in dekaminute counter 34 via enabled gate 638 to audible coding circuit 636, where the number is converted into an audible readout in a manner heretofore described, and is applied via gate 615 and amplifier 46 to the transducer 45.

Scanner 60 then steps scanner 68 to its fourth active position, and the user is now afforded an opportunity to change the number stored in the dekaminute alarm counter 34, by tapping one or more times on transducer 45, in a manner identical to that described hereinabove in changing the setting stored in the hour alarm counter 35.

When the user no longer taps transducer 45 to advance the number stored in counter 34, the scanner 60 will then step scanner 68 to its fifth active position, in which the scanner applies a pulse via line 22 to enable AND gate 621. Flip flop 627, whose output is the other input to gate 621, may be either in the arm or disarm condition, and will thus cause gate 621 to produce an output of either a "one" or a "zero", which is applied through enabled gate set 638 to audible coding circuit 636. The latter circuit will then produce, by the circuitry heretofore described in connection with FIG. 13, an output audible signal via gate 615 and amplifier 46, which informs the user as to whether flip flop 627 is in its armed or its disarmed condition. Scanner 60 then steps scanner 68 to its sixth active position, which enables gate sets 629 and 631 so that, if the user wishes to reverse the condition of flip flop 627 from the condition which he has just learned, the user may do so by a tap on transducer 45, which generates a signal fed through the enabled gates 629 and 631, to toggle flip flop 627 to its other condition.

As in other readout cycles of the present apparatus, scanner 60 will then step scanner 68 to its seventh active position which, in the manner described before, will reset the entire system into its quiescent condition, prepared for a subsequent interrogation by the user.

As previously mentioned, if the user steps selection register to its third active position, the subsequent cycle of scanner 68 will read out the information stored in the special counters 623, 624 and 625. It will be recalled that these counters have stored therein any desired information which changes chronologically, such as date and month or the like. As in the case of the alarm readout, the user is afforded an opportunity to change the numbers stored in counters 623, 624 and 625, by one or more taps on transducer 45 during the interval immediately after he hears the audible readout of the number in each of those counters. Line 626 from counter 15 feeds counter 623.

It will be recalled that the fourth active position of selection register 608 provides three capabilities relating to clock time, namely the ability for the user (1) having just heard an audible readout of the number of hours stored in the clock time counter 15, to change that number; (2) having just heard a tone signal informing him whether the automatic hourly readout is armed or disarmed, the ability to reverse that condition; and (3) to set or calibrate the apparatus against a standard time signal. These functions will now be described in detail.

The fourth active position of selection register 608 enables gate sets 633 and 640. The first active position of scanner 68 provides a signal on line 24 which enables gate set 20, thereby supplying to the coding circuit 636 via gate set 640 the coded number stored in the clock time hour counter 15, and coding circuit 636 produces the corresponding output tone signal. If the user wishes to change that hour setting, as in traveling between time zones or the like, then during the time when scanner 68 is in its second active position, he taps transducer 45 the appropriate number of times, each such tap generating a signal applied via gate sets 629 and 633 to advance by one the number stored in counter 15. As in the case of the corresponding correction of the alarm settings, each tap-generated signal, via enabled gate 610, sets flip flop 611, so the user has time to advance the clock time hour by as many steps as he wishes.

When scanner 68 is in its third active position, it interrogates the condition of the automatic hourly readout function of the present invention and produces a tone signal informing the user of that condition. When the scanner is in its fourth active position, the user can change that condition. More particularly, the third active position of scanner 68 applies a signal via line 23 to enable AND gate 622, so that that gate feeds to gate set 640 a "one" or a "zero" signal from flip flop 628 indicating whether that flip flop is in its armed or disarmed condition. Such signal is fed by gate set 640 to audible coding circuit 636, which produces the corresponding audible signal. When scanner 68 is now stepped to its fourth active position, the user is provided an opportunity to reverse that condition of flip flop 628 by applying a tap-generated signal via gate set 629, cable 630 and gate set 633, in order to toggle flip flop 628 to its opposite condition. If the user does not tap the transducer, flip flop 628 of course remains in its condition, whichever that may be.

The fifth and sixth active positions of scanner 68 provide means for setting or calibrating the clock time of the present apparatus against an acknowledged standard on the hour such as an hourly beep signal broadcast by station WWV in Washington, D.C. It will be noted that, when scanner 68 is in its fifth active position, it does not supply a signal to gate set 640, although that gate set is enabled by the fourth position of selection register 608. Accordingly, the inputs of coding circuit 636 from that gate set are "zero," and the coding circuit produces the corresponding audible signal during one cycle of scanner 60. When scanner 68 is stepped to its sixth active position, it enables gate sets 629 and 633. If now the user, having been alerted by the comparatively long (one or two second) zero signal, taps transducer 45 while scanner 68 is in its sixth position, the signal thus generated will set flip flop 641, which (1) disables gate 609, thus stopping the flow of stepping pulses from pulse coder 604 to scanner 60; (2) resets and holds at zero at least some stages of the high frequency counter 12 and clock time counters 13 and 14; and (3) enables AND gate 642, which is thus ready to pass the output from gate 601 produced by the next tap by the user, to reset flip flop 641. It will be understood that the clock time hour counter 15 has heretofore been set by the user, in the manner previously described, to the next approaching hour. Under these conditions, the user than awaits the arrival of the hourly beep signal, indicating that the hour set in hour counter 15 has arrived, and the user then immediately taps transducer 45. The pulse thus generated is fed from gate 601 to enabled gate 642, which resets flip flop 641. This removes the disabling signal theretofore applied to gate 609, and also removes the zero reset signal applied to counters 12, 13 and 14, thus permitting code digit scanner 60 to receive stepping signals from pulse coder 604, permitting the counters to resume normal operation.

In FIG. 13, the zero reset signal from flip flop 641 is shown applied to section **12*b*, including stages 18, 19, 20 and 21 of the high frequency counter. As will be apparent, this permits an error of no more than four seconds in starting the operation upon hearing the beep signal. If greater accuracy is desired, the stages of section 12*a*** of the high frequency counter could of course be held reset to zero.

From the viewpoint of security, it is particularly to be noted that the function of changing the clock time setting of the present apparatus can be accomplished only by the user's advancing selection register 608 to its fourth position by a sequence of carefully timed taps, and then proceeding in the manner just described. Accidentally produced taps would almost certainly include more than one tap during a single cycle of scanner 60, which as previously explained, would return the entire system to its quiescent condition.

The alarm check of the present system, as previously mentioned generally, is performed every ten minutes, provided that the user has armed the alarm mode by toggling flip flop 627 to its armed condition, thus enabling AND gate 643. The alarm check function will now be described in detail, with reference particularly to the internal circuitry of alarm circuit 644 as shown in FIG. 13. Thus alarm circuit 644 includes a set of EXCLUSIVE OR gates 671–674, and each of these has two inputs for receiving the outputs of time gate set 635 and alarm gate set 638. The outputs of gates 671–674 are fed via OR gate 675 to the reset input of flip flop 678. Assuming that flip flop 627 is in its armed condition and gate 643 is thus enabled, alarm dekaminute counter 14 applies a triggering pulse every ten minutes to set flip flop 679 (FIG. 13) of alarm circuit 644. This produces a signal in line 802, which performs several functions. First, via line 803, it disables gate 182 of audible coding circuit 636, so that no automatic hourly readout can occur. Secondly, it inhibits selection register 608, so that no tap-generated pulse can initiate a readout. Thirdly, it enables AND gate 645, which applies a very high speed stepping frequency, illustratively 16,384 Hz from the first stage of counter 12*a*, to decimal digit scanner 68. Fourthly, via OR gates 634 and 637, it enables gate sets 635 and 638 respectively. Thus, with a high frequency stepping signal being applied to scanner 68, the enabled outputs of time gate set 635 and alarm gate set 638 are synchronously fed to alarm circuit 644, and more particularly to the inputs of EXCLUSIVE OR gates 671–674 previously mentioned.

If the pairs of binary number outputs from gate sets 635 and 638 are not the same, the output from at least one of the EXCLUSIVE OR gates 671–674 will pass via OR gate 675 to reset flip flop 678, thus disabling gate 680. It may be noted that, during a tap-interrogated readout of either clock time or alarm setting, only one of gate sets 635 or 638 will be enabled, and hence each of the gates 671–674 produces an output signal so flip flop 678 under these conditions will always be reset. But during an alarm check the functioning proceeds as set forth above, and when scanner 68 reaches its seventh active position, it resets the entire system to quiescent condition as previously described, including the setting of flip flop 678 and the resetting of flip flop 679.

On the other hand, if the pairs of binary number outputs from gate sets 635 and 638 are the same, thus calling for an alarm, gates 671–674 will not produce an output. Flip flop 678 therefore remains in its set condition and gate 680 remains enabled. As seen in FIG. 13, the output of the fourth active position of scanner 68 will then pass AND gate 680, and thereby set flip flop 681 and enable AND gate 669. Setting of flip flop 681 also applies a signal via OR gate 617 to hold selection register 608 in reset condition.

With gate 669 enabled, it passes the alarm signal from gate 666 on to gate 615 to sound the alarm. The output signal of gate 666 has a frequency of about 500 Hz in ½ second tone bursts every two seconds. During the intervals between tone bursts, the inverted output of AND gate 667 enables AND gate 668, permitting the user to turn off the alarm by applying a tap-generated pulse from gate 601 to the other input of gate 668, whose output signal, via OR gate 670, resets flip flop 681. If the user does so, then the output of gate 603 from the tap-generated pulse steps selection register 608 to its first active position, thereby producing a readout of clock time to confirm to the user the time at which the alarm sounded.

If the user does not turn off the alarm, the output of the 20th stage of counter 12*b* will do so after about 16 seconds by applying a signal via gate 670 to reset flip flop 681.

When flip flop 628 is in its condition for automatic hourly readouts of the hour, it enables AND gate 646 to pass an hourly signal from counter 15 to AND gate 647. If selection register 608 is in its reset position, AND gate 647 will be enabled, thus passing the signal from counter 15 on to set flip flop 648 and, through OR gate 606 and AND gate 607, to step selection register 608 to its first position. This starts a clock time readout in the usual manner. After producing an audible representation of the number in hour counter 15, decimal digit scanner 68 is stepped to its second position, which applies a signal to AND gate 649. Because AND gate 649 is already enabled by reason of the set condition of flip flop 648, the signal from the second position of scanner 68 passes through the gate and (1) directly resets flip flop 648 and (2), via OR gate 617, resets code digit scanner 60, decimal digit scanner 68 and selection register 608. Thus the readout is terminated immediately after the audible representation of the hour from counter 15.

As shown in FIG. 16, means may be provided for producing a short tone burst each hour on the hour to alert the wearer, instead of the sequence of tone signals identifying the hour, as just described. The output of AND gate 646 on the hour toggles flip flop 766 to the condition which enables AND gate 767, thereby passing the tone signal from AND gate 663 to pulse coder 604 to OR gate 615, whose output signal is amplified at 46 to drive transducer 45. After one pulse burst has been thus passed, the signal from the 13th state of counter 12 will reset flip flop 766, thus disabling AND gate 767. Under these conditions the following circuit elements of FIG. 12 will not be needed: AND gates 647, 649 and 650, flip flop 648, and OR gate 606. The output of the reset position of decimal digit scanner 68 will then be applied directly to AND gate 607. Thus, when gate 646 is enabled by flip flop 628, each hour will be marked by an audible tone burst.

With further reference to FIG. 13 and to FIG. 14*a*, showing waveforms of important components of pulse coder 604, it will be seen that counter 12*a* is supplied from the timing element (not shown in FIG. 13) with an input signal desirably of 32,768 Hz. The highest frequency output of counter 12*a*, approximately 16 kHz, is fed to gate 645 in order to provide a very high frequency stepping signal to scanner 68 during the periodic alarm checks previously described. AND gate 660 receives the outputs of stages two, three and four of counter 12*a*, which are square waves having frequencies of approximately 8, 4, and 2 kHz respectively. As shown in the first line of FIG. 14*a*, the output of gate 660 is a pulse of approximately 1/16th millisecond duration occurring at a rate of approximately 2 kHz. This output is fed to gate 614 of FIG. 12 and thence to transducer 45, as the tone signal to indicate to the user that scanner 60 will make another cycle before stepping scanner 68, and that therefore a time period of approximately 1.5 seconds is beginning during which the user can tap transducer 45 in order to advance selection register 608 to its next position, all as previously described in connection with FIG. 12.

The output of gate 660 also goes to AND gates 661, 662 and 663. AND gate 664 receives the outputs of the fifth and sixth stages of counter 12*a*, and develops therefrom a square pulse at a frequency of approximately 500 Hz, with a one-fourth duty cycle. This pulse is applied to AND gate 661, so that only one-fourth of the input pulses applied to gate 661 by gate 660 appear in the output of gate 661, as shown on the second line of FIG. 14*a*. The outputs of the fifth and sixth stages of the counter are applied in inverted form to AND gate 665, so that the output of the latter gate has the same shape as the output of gate 664, except that the pulse occurs at a different point in the cycle. This difference in the input to AND gate 662 causes the latter to pass a different fourth pulse from gate 660 from that passed by gate 661, as shown by the waveform on the third line of FIG. 14*a*. The output of gate 661 energizes AND gates 601 and 605 of FIG. 12, while the output of gate 662 energizes gate 603 of FIG. 12, thus providing a two phase output for each tap on transducer 45.

The output of gate 661 also goes to AND gate 666 and, in coding circuit 636, to OR gate 175 and AND gate 180. AND gate 663 receives the outputs of the eleventh and twelfth stages of the counter, along with the output of gate 660. As shown in the first line of FIG. 14*b*, the output waveform of gate 663 includes a series of pulse bursts 1/32nd second long occurring every ⅛th second. The pulses in each burst are those of the output from gate 660.

The output of the thirteenth stage constitutes the stepping signal for code digit scanner 60 at approximately 4 Hz, which produces the outputs shown by the waveforms in the remaining lines of FIG. 14*b*.

AND gate 667 receives the outputs of the fifteenth and sixteenth stages of the counter, and provides an input to gate 666 of the pulse coder and, inverted, to AND gate 668 alarm circuit 644. The output of AND gate 666 goes to gate 669 of alarm circuit 644, and the output of the twentieth stage of counter 12*b* is applied to OR gate 670 of the alarm circuit, for purposes previously described in connection with the description of that circuit.

As previously mentioned in connection with the description of FIG. 4, certain details of the optical display readout in accordance with the present invention are shown in FIG. 15, and will now be described. The apparatus of FIG. 15 effectively replaces audible coding circuit 636 of the apparatus of FIG. 12, in order to produce a visual or optical display of the information readout. It will be recognized that both audible and visual readouts could be incorporated in a single device if desired.

Input gate set 701 is shown receiving the outputs of gate sets 635,638,639 and 640, and producing therefrom outputs on lines 21*a–d* applied to segment select logic 120. Input gate set 701 may consist simply of four OR gates, each producing an output on one of lines 21*a–d*, and receiving the inputs from gate sets 635, 638, 639 and 640 for the corresponding digit.

The outputs on lines 21*a–d* are converted by segment select logic 120 to a set of drive signals to decimal digit visual display 121 to produce a display of the number represented by the combination of inputs. AND gates 702 and 703 respond to the outputs on lines 21*a*, 21*b*, and 21*c* to produce an output from OR gate 704 whenever the number represented is a 10, 11, or 12. AND gates 705 and 706 convert the outputs on lines 21*a* and 21*b* for the numbers 10, 11, and 12 to outputs for the same digits for the numbers 0, 1, and 2 respectively. AND gates 703 and 707 drive OR gate 708 to convert the output on line 21*c* for the numbers 10, 11, and 12 to an output to represent the numbers 0, 1, and 2 respectively. The outputs of AND gates 705 and 706 and OR gate 708 for the numbers 0 through 9 are thus the same as the outputs on lines 21*a*, 21*b*, and 21*c* respectively.

The output of OR gate 704 is applied to drive 709 to energize element 710 of display 121 whenever the number represented by the outputs on lines 21*a* through 21*d* is a 10, 11, or 12. The outputs of AND gates 705 and 706, OR gate 708, and line 21*d* are applied to the binary-to-7-segment encoder 711 which drives the 7 segment display 712. Binary-to-7-segment encoder 711 converts the binary representations for the numbers 0 through 9 to drives for the corresponding combinations of segments to produce displays of numbers 0 through 9. The input to encoder 711 for the numbers 10, 11, and 12 represented on lines 21*a* through 21*d* are those for the numbers 0, 1, and 2. Driver 709 receives an input when the numbers 10, 11, and 12 are represented on lines 21*a* through 21*d*. Element 710 and 7 segment display 712 thus present the numbers 0 through 12 in response to their representations by the outputs on lines 21*a* through 21*d*.

Binary-to-7-segment encoder 711 may be of the type disclosed in the prior referenced U.S. Pat. No. 3,672,155 and Apr. 10, 1972 issue of Electronics. These references also disclose visual displays such as element 710 and 7 segment display 712 of decimal digital visual display 121. Segment select logic 120 also includes power supply 713 and OR gate 714. Power supply 713 will be an a-c supply if decimal digit visual display 121 uses liquid crystal elements. The output of OR gate 714 inhibits the outputs of drive 709 and encoder 711 when that gate receives an inhibiting input either from alarm circuit 644 during an alarm check or from decimal digit scanner 68 when it is in its reset position.

Decimal digit scanner 68 can have fewer positions than it does in FIG. 12 with audible coding circuit 636 because control and display can use the same position. Lines 24, 23, and 22 which energize the readout of the successive digits of the selected set can also energize gate set 629 for control of the same digit at the same time. The user can then see the digit change in response to his taps on sound transducer 45.

In the embodiment of the invention shown in FIG. 12, the acoustic transducer 45 has been disclosed as constituting the means selectively operable by the user for sequentially applying interrogation and/or control pulses to the input component of the circuitry, comprising flip flop 600. In FIG. 17 there is shown an alternative form of such means which may be employed in the apparatus of FIG. 12, by which the user sequentially actuates a switch such as a push button switch to provide the desired pulses, instead of sequentially tapping on the electroacoustic transducer. In FIG. 17, such a sequential pulse applying means is shown in association with flip flop 600 of FIG. 12. It will be understood that, since the subcircuit of FIG. 17 constitutes a source of pulses which is effectively a substitute for the amplified tap-generated pulses heretofore referred to, amplifier 47 of FIG. 12 is unnecessary and would be eliminated in using the subcircuit of FIG. 17. No other changes of the earlier described apparatus are contemplated or necessary.

Referring now in detail to FIG. 17, the output of AND gate 901 is applied to the set input of flip flop 600. In the quiescent state of the subcircuit of FIG. 17, a selectively actuated switch 902 is in its position shown in solid lines, thus grounding the portions of the circuit shown connected to the common terminal of switch 902, and flip flop 903 is in its reset condition, thus enabling gate 901. When the user wishes to apply an interrogation or a control pulse to the watch apparatus, he moves the blade of switch 902 to its position shown in dotted outline in FIG. 17, thus applying power from a source 904 through enabled gate 901, to set flip flop 600. The same power applied to the set input of flip flop 903 causes the latter to commence its transition to its set condition, but the time delay characteristics of the flip flop are such that gate 901 remains enabled long enough to pass the voltage pulse from source 904 to the set input of 600. So long as the user holds switch 902 in its dotted line position, flip flop 903 will remain set, thus disabling gate 901 and preventing further application of the voltage from source 904 to the set input of flip flop 600. Subsequently, when the user permits the blade of switch 902 to return to its grounded contact, the condition of the switch 902, inverted by inverter 905, enables AND gate 906 so that a subsequent signal from reset output 605 of flip flop 600 will pass through gate 906 and reset flip flop 903. The circuit is thus returned to its quiescent state, prepared to apply another interrogating or control pulse to the set input of flip flop 600, upon a subsequent actuation of switch 902 by the user.

It will accordingly be seen that the present device provides means for storing and retrieving data, particularly information relating to time, and that the interrogation and control of the device are conveniently and economically accomplished by a series of switch actuations or taps on a sound transducer which itself is used also for audible readouts, and for providing an alarm capability. It will be understood that in most instances the frequencies mentioned hereinabove as audible signals are derived as submultiples of the driving frequency of 32,768 Hz. Hence the frequency of "approximately 500 Hz" should be understood to mean 512 Hz and "approximately 2000 Hz" to mean 2096 Hz, etc.

I claim:

1. In an electronic watch having a high frequency timing element and a high frequency counter driven by said timing element, the combination of:

(a) a time register driven by said counter for storing information representative of time;

(b) a sound transducer;

(c) means coupled to said sound transducer and to said time register for triggering a readout of the time stored in said register responsive to a tap on said sound transducer;

(d) means responsive to said triggering means for driving said transducer with signals representing the time stored in said time register; and (e) means for coupling said driving means to said time register.

2. The combination according to claim 1 wherein said time register stores said time representative information as information representative of a plurality of digits.

3. The combination according to claim 2 wherein said driving means produces a sequential code representation for each of said plurality of digits, said code consisting of combinations of signals from said counter.

4. The combination according to claim 2 including means coupled to said sound transducer and said time register responsive to repetitive taps on said sound transducer for changing the digits stored in said register.

5. The combination according to claim 2 including an alarm register for storing information representative of a plurality of digits, means coupled to said time register and said alarm register for sensing when said alarm register and said time register store the same digits; and means coupled to said sensing means and said high frequency counter for producing an alarm signal to drive said sound transducer responsive to said sensing means.

6. The combination according to claim 5 including means coupled to said sound transducer and said alarm register responsive to repetitive taps on said sound transducer for changing the digits stored in said alarm register.

7. The combination according to claim 5 including second means for coupling said driving means to said alarm register; and means coupled to said sound transducer and said driving means and responsive to repetitive taps on said sound transducer for selecting said alarm register in place of said time register for representation by said driving means.

8. In an electronic watch having a high frequency timing element and a high frequency counter driven by said timing element, the combination of:

(a) a sound transducer, (b) a time register driven by said high frequency counter, (c) an alarm register, (d) means coupled to said time register and said alarm register for sensing when said time register and said alarm register store the same digits, (e) means coupled to said sensing means and said high frequency counter for producing an alarm signal to drive said sound transducer responsive to said sensing means, and (f) means coupled to said alarm register and responsive to a tap on said sound transducer for driving said sound transducer with a sequential code representing each of the digits stored in said alarm register in turn.

9. The combination according to claim 8 including means coupled to said sound transducer and said alarm register and responsive to further taps on said sound transducer for changing the digits stored in said alarm register.

10. In an electronic time keeping device having a timing element, a counter driven by said timing element, and a time register driven by said counter storing the time in electrical form, the combination of:

(a) means coupled to said counter and said time register for intermittently producing a sequential series of signals which represent the time stored in said time register according to a predetermined code, and (b) a sound transducer driven by the signals from said producing means to provide an audible presentation of said signals.

11. The combination according to claim 10 wherein said producing means includes means for triggering the production of said sequential series of signals.

12. The combination according to claim 11 wherein said triggering means is actuated at periodic intervals by said time register.

13. The combination according to claim 11 wherein said triggering means is also coupled to said sound transducer and is also responsive to a tap on said sound transducer.

14. The combination according to claim 11 including an alarm register storing a time representation in electrical form, means coupled to said time register and said alarm register for comparing the time representations in said time register and said alarm register, and means coupled to said comparing means and said counter for applying an alarm signal to drive said sound transducer when the time representations in said time and alarm registers are the same.

15. The combination according to claim 14 including a second producing means connected to said alarm register which produces a second sequential series of signals representing the time stored in said alarm register, wherein said comparing means receives the signals from said producing means and said second producing means to determine when the times in said registers are the same.

16. The combination according to claim 15 including means for selecting the signals from said producing means or said second producing means for the time in either said time register or said alarm register to drive said sound transducer.

17. The combination according to claim 16 wherein said triggering means is responsive to a tap on said sound transducer and said selecting means is responsive to two successive taps on said sound transducer to get signals from said second producing means.

18. The combination according to claim 14 including means coupled to said alarm register for changing the time stored in said alarm register in response to taps on said sound transducer.

19. The combination according to claim 11 wherein said triggering means is responsive to a tap on said sound transducer and including means coupled to said time register for changing the time stored in said time register in response to successive taps on said sound transducer.

20. The combination according to claim 10 including means coupled to said time register for changing the time stored in said time register in response to taps on said sound transducer.

21. The combination according to claim 10 wherein said sequential series of signals include different code characters having different signal characteristics.

22. The combination according to claim 21 wherein said different signal characteristics result in different tonal qualities in the output from said sound transducer.

23. The combination according to claim 21 wherein said different signal characteristics include a difference in time duration.

24. In an electronic time keeping device, the combination of:

(a) a timing element;
(b) a time register fed by the timing element;
(c) a readout transducer for presenting time information;
(d) means coupled to said time register and said readout transducer responsive to a signal pulse for reading out the contents of said time register to said readout transducer;
(e) a sound transducer; and
(f) means for coupling said reading means to said sound transducer so the output signal pulse of said sound transducer resulting from a tap on said sound transducer triggers said reading means to produce a readout.

25. The combination according to claim 24 including an alarm register, means for switching said alarm register to said reading means in place of said time register, and means coupled to said sound transducer and said switching means and responsive to a plurality of output signal pulses of said sound transducer occurring within predetermined time relation with one another for operating said switching means.

26. The combination according to claim 24 wherein said readout transducer includes an optical display.

27. In an electronic timepiece having a high frequency timing element, a frequency dividing means driven by the timing element and a time register for storing information representative of hours and minutes, said timepiece having a plurality of operational states, the combination of:

(a) a single control operable by the user of said timepiece, said single control having a single manually actuatable element;
(b) means responsive to starting actuations of said single manually actuatable control element for selecting operational states of said timepiece;
(c) means responsive to subsequent actuations of said single manually actuatable control element which occur within a predetermined period following one of said starting actuations for changing the numbers stored in said time register;
(d) an alarm register;
(e) means coupled to said alarm register and said time register for producing an alarm indication when the contents of said alarm register and said time register are the same; and
(f) means coupled to said alarm register and enabled by one of said operational states for changing the contents of said alarm register in response to further actuations of said single manually actuatable control element.

28. The combination according to claim 27 wherein said single manually actuatable control element consists of a sound transducer which produces a voltage pulse when manually actuated by taps thereon.

29. In an electronic timepiece having a high frequency timing element, and a frequency dividing means driven by the timing element and including a time register for storing time based information representative of hours and minutes, the combination of:

(a) a sound transducer;
(b) means for applying an audible frequency signal from said frequency dividing means to drive said sound transducer;
(c) means coupled to said time register for activating said applying means for a short interval in response to selected periodic changes in the information stored in said time register;
(d) means coupled to said frequency dividing means and to said time register for encoding signals from said frequency dividing means to represent time based information stored in said time register;
(e) said applying means when activated applying said encoded signals to said sound transducer; and
(f) means responsive only to a selected number of voltage pulses each caused by a tap on said transducer for selectively enabling and disabling said activating means.

30. An electronic timepiece comprising:

(a) a high frequency timing element;
(b) means driven by the timing element for producing signals representing time based information;
(c) a plurality of registers connected to receive and driven by said time based information signals for storing time based information represented thereby;

(d) means for reading out said time based information stored in said registers to the user, said read out means including an input, said read out means comprising optical display means having a set of optical display elements capable of simultaneously displaying less than all of the time based information stored in said plurality of registers and capable of simultaneously displaying only the time based information stored in selected ones of said plurality of registers, said selected ones of said registers being less than all of said registers, said optical display means alternatively displaying the time based information stored in first selected ones of said registers and second selected ones of said registers on the same set of optical display elements;

(e) a single control having only a single manually actuatable control element with a single actuated position for effecting implementation of selected operational states each of which effects selective production and application of an output representative of the time based information stored in said registers to said input of said read out means;

(f) selection means responsive to manual actuations of said single control element to said single actuated position for implementing selected ones of said plurality of operational states as a function of and in response to different numbers of said manual actuations of said single control element;

(g) first means activated by a first selected one of said operational states implemented in response to a first number of said manual actuations of said single control element to said single actuated position for producing and applying a first selected output representative of the time based information stored in only said first selected ones of said registers to said input of said read out means without disconnecting said first selected registers from said time based information signals; and (h) second means activated by a second selected one of said operational states implemented in response to a second number of said manual actuations of said single control element to said single actuated position for producing and applying a second selected output representative of the time based information stored in only said second selected ones of said registers to said input of said read out means without disconnecting said second selected registers from said time based information signals;

said optical read out means reading out that information corresponding to the time based information stored in said first selected ones of said registers and represented by said first selected output on said same set of optical display elements in response to said first number of actuations of said single control element to said single actuated position and alternatively reading out information corresponding to the time based information stored in said second selected ones of said registers and represented by said second selected output on said same set of optical display elements in response to said second number of actuations of said single control element to said single actuated position.

31. A timepiece according to claim 30 wherein:

said selection means implements said second selected one of said operational states in response to said second number of said manual actuations of said single control element only if said second number of said manual actuations to said single actuated position occur within a first predetermined finite time period after said first number of said manual actuations to said single actuated position.

32. A timepiece according to claim 31 including:

means enabled by another of said operational states for altering the information stored in said selected ones of said registers in response to further manual actuations of said single control element to said single actuated position within a second predetermined finite time period following said first predetermined finite time period.

33. A timepiece according to claim 30 wherein:

said single control element and said read out means comprise a sound transducer.

34. A timepiece according to claim 30 wherein:

said single manually actuatable control element is a sound transducer activated when tapped.

35. A timepiece according to claim 30 wherein:

said single manually actuatable control element is a single manually operated switch having a single manually operated actuator and a single set of contacts.

36. An electronic timepiece having a plurality of operational states comprising:

(a) a high frequency timing element;

(b) frequency dividing means driven by the timing element for producing time based information signals;

(c) a plurality of information storing registers connected to receive and driven by said time based information signals for storing time based information represented by said signals including time based information representative of hours and minutes;

(d) a single manually actuatable control having only a single manually actuated control element for effecting selection of said operational states and thereby selection of various different ones of said registers;

(e) means responsive to an initial manual actuation of said single control element for selecting one of said operational states of said timepiece and responsive to a selected number of subsequent manual actuations of said single control element within a predetermined finite time period after said initial actuation for selecting another of said plurality of operational states of said timepiece;

(f) means responsive to said one operational state for selecting first ones of said registers being less than all of said registers and responsive to said other operational state for selecting second ones of said registers being less than all of said registers;

(g) read out means including optical display means having a set of optical display elements capable of communicating to the user only the time based information stored in said selected ones of said plurality of registers, said read out means having an input; and (h) means for producing and applying an output representative of information stored in said selected ones of said plurality of registers to said input of said read out means without disconnecting said selected ones of said plurality of registers from said time based information signals;

whereby an output representing the time based information stored in said selected first ones of said registers and an output representing the time based information stored in said second selected ones of said registers are alternatively applied to said display means and alternatively displayed utilizing said set of optical display elements.

37. A timepiece according to claim 36 including:

means responsive to a selected number of additional manual actuations of said single control element within a second predetermined finite time period after said initial manual actuation of said single control element for changing the information stored in one of said registers.

38. A timepiece according to claim 36 wherein:

said single manually actuatable control element is a sound transducer actuated when tapped.

39. A timepiece according to claim 36 wherein:

said single manually actuated control element is a single manually operated switch having a single manually operated actuator and a single set of contacts.

40. An electronic timepiece having a high frequency timing element and a frequency dividing means driven by the timing element for producing time based information signals, comprising:

(a) a plurality of registers connected to receive and responsive to said time based information signals for storing time based information represented thereby;

(b) read out means having an input for reading out information corresponding to an output signal applied to said input, said read out means comprising optical display means having a set of optical display elements capable of simultaneously displaying less than all of the time based information stored in said plurality of registers and capable of simultaneously displaying only the time based information stored in selected ones of said plurality of registers, said selected ones of said registers being less than all of said registers, said optical display means alternatively displaying the time based information stored in first selected ones of said registers and second selected ones of said registers on the same set of optical display elements;

(c) a single manually actuatable control element having a single actuated position;

(d) means responsive to manual actuation of said single control element to said single actuated position for selecting different ones of said registers without disconnecting said selected ones of said registers from said time based information signals, said selected ones of said registers being less than all of said registers, and for applying an output signal representative only of the time based information stored in said selected ones of said registers to said input of said read out means, the ones of said registers selected being a function of the number of actuations of said single control element to said single actuated position.

41. A timepiece according to claim 40 including:

means responsive to selected additional manual actuation of said single control element to said actuated position for changing the information stored in said selected ones of said registers.

42. A timepiece according to claim 40 wherein:

said single manually actuated control element is a sound transducer actuated when tapped.

43. A timepiece according to claim 40 wherein:

said single manually actuated control element is a single manually operated switch having a single manually operated actuator and a single set of contacts.

44. An electronic timepiece comprising:

(a) a high frequency timing element;

(b) means driven by the timing element for producing signals representing time based information;

(c) a plurality of registers driven by said time based information signals for storing time based information represented thereby and for producing a plurality of outputs representative thereof;

(d) means for reading out said time based information stored in said registers to the user, said read out means including an input and comprised of optical display means having a set of optical display elements having the limited to capability of displaying less than all of the time based information stored in said registers;

(e) a single control having only a single manually actuatable control element and a single actuated position for effecting implementation of selected operational states each of which effects selective application of outputs representative of the time based information stored in selected ones of said registers to said input of said read out means;

(f) selection means responsive to manual actuations of said single control element to said single actuated position for implementing selected ones of said plurality of operational states as a function of and in response to different numbers of said manual actuations of said single control element;

(g) first means activated by a first selected one of said operational states implemented in response to a first number of said manual actuations of said single control element to said single actuated position for applying outputs representative of the time based information stored in only first selected ones of said registers to said input of said read out means, said first selected ones of said registers being less than all of said registers; and (h) second means activated by a second selected one of said operational states implemented in response to a second number of said manual actuations of said single control element to said single actuated position for applying outputs representative of the time based information stored in only second selected ones of said registers to said input of said read out means, said second selected ones of said registers being less than all of said registers;

said read out means displaying information corresponding to the outputs applied thereto representative of the time based information stored in said first selected ones of said registers on said set of display elements in response to said first number of actuations of said single control element to said single actuated position and alternatively displaying information corresponding to the outputs applied thereto representative of the time based information stored in said second selected ones of said registers on said same set of display elements in response to said second number of actuations of said single control element to said single actuated position.

45. A timepiece according to claim 44 wherein:

said selection means implements selected ones of said operational states only in response to said manual actuations of said single control element to said single actuated position ocurring within a selected first predetermined finite time period.

46. A timepiece according to claim 45 including:
means enabled by another of said operational states for altering the information stored in said selected ones of said registers only in response to further manual actuations of said single control element to said single actuated position occuring within a second finite predetermined time period following said selected first predetermined finite time period.

47. A timepiece according to claim 44 wherein:
said single manually actuatable control element is a single manually operated switch having a single manually operated actuator and a single set of contacts.

48. An electronic timepiece having a plurality of operational states comprising:
(a) a high frequency timing element;
(b) frequency dividing means driven by the timing element for producing time based information signals;
(c) a plurality of information storing registers driven by said time based information signals for storing time based information represented by said signals including time based information representative of hours and minutes;
(d) a single manually actuatable control having only a single manually actuated control element for effecting selection of said operational states and thereby selection of said registers;
(e) means responsive to an initial manual actuation of said single control element for selecting one of said operational states of said timepiece and responsive to a selected number of subsequent manual actuations of said single control element within a predetermined finite time period after said initial actuation for selecting another of said plurality of operational states of said timepiece;
(f) means responsive to said one operational state for selecting first ones of said registers, said selected first ones of said registers being less than all of said registers, and responsive to said other operational state for selecting second ones of said registers, said selected second ones of said registers being less than all of said registers;
(g) read out means including optical display means having a set of optical display elements capable of simultaneously displaying less than all of the time based information stored in said plurality of registers and capable of simultaneously displaying only the time based information stored in said selected ones of said plurality of registers for communicating to the user only the time based information stored in said selected ones of said plurality of registers; and
(h) means enabled by each of said operational states for applying only the outputs representative of information stored in said selected ones of said plurality of registers to said optical display means;
whereby only the time based information stored in said selected first ones of said registers and only the time based information stored in said selected second ones of said registers is alternatively displayed utilizing said set of optical display elements.

49. A timepiece according to claim 48 including:
means responsive to a selected number of additional manual actuations of said single control element within a second finite time period after said initial manual actuation of said single control element for changing the information stored in one of said registers.

50. A timepiece according to claim 48 wherein:
said single manually actuated control element is a single manually operated switch having a single manually operated actuator and a single set of contacts.

51. An electronic timepiece having a high frequency timing element and a frequency dividing means driven by the timing element for producing time based information signals, comprising:
(a) a plurality of registers responsive to said time based information signals for storing time based information represented thereby;
(b) read out means comprised of optical display means having at least one set of optical display elements, said one set of optical display elements being capable of simultaneously displaying less than all of the time based information stored in said plurality of registers and being capable of simultaneously displaying only the time based information corresponding to an output signal applied thereto representative of time based information stored in selected ones of said registers, said selected ones of said registers being less than all of said registers;
(c) a single manually actuatable control element having a single actuated position and;
(d) means responsive to manual actuation of said single control element to said single actuated position for selecting different ones of said registers, said selected ones of said registers being less than all of said registers, and for applying an output signal representative only of the time based information stored in said selected ones of said registers to said read out means, the ones of said registers selected being a function of the number of actuations of said single control element to said single actuated position.

52. A timepiece according to claim 51 including:
means responsive to selected additional manual actuation of said single control element to said single actuated position for changing the information stored in said selected ones of said registers.

53. A timepiece according to claim 51 wherein:
said single manually actuated control element is a single manually operated switch having a single manually operated actuator and a single set of contacts.

54. An electronic timepiece comprising:
(a) a high frequency timing element;
(b) means driven by the timing element for producing signals representing time based information;
(c) a plurality of registers connected to receive and driven by said time based information signals for storing time based information represented thereby;
(d) means for reading out said time based information stored in said registers to the user, said read out means including an input, said read out means comprising optical display means having a set of optical display elements capable of simultaneously displaying less than all of the time based information stored in said plurality of registers and capable of simultaneously displaying only the time based information stored in selected ones of said plurality of registers, said selected ones of said registers being less than all of said registers, said optical display means alternatively displaying the time based information stored in first selected ones of said registers and second selected ones of said registers on the same set of optical display elements;

(e) a single control having only a single manually actuatable control element for effecting implementation of selected operational states each of which effects selective production and application of an output representative of the time based information stored in said registers to said input of said read out means;

(f) selection means responsive to manual actuations of said single control element for implementing selected ones of said plurality of operational states as a function of and in response to different numbers of said manual actuations of said single control element, said selection means implementing said second selected one of said operational states in response to said second number of said manual actuations of said single control element only if said second number of said manual actuations occur within a selected first predetermined finite time period after said first number of said manual actuations;

(g) first means activated by a first selected one of said operational states implemented in response to a first number of said manual actuations of said single control element for producing and applying a first selected output representative of the time based information stored in only said first selected ones of said registers to said input of said read out means without disconnecting said first selected registers from said time based information signals; and (h) second means activated by a second selected one of said operational states implemented in response to a second number of said manual actuations of said single control element for producing and applying a second selected output representative of the time based information stored in only said second selected ones of said registers to said input of said read out means without disconnecting said second selected registers from said time based information signals;

whereby said optical read out means reads out that information corresponding to the time based information stored in said first selected ones of said registers and represented by said first selected output on said same set of optical display elements in response to said first number of actuations of said single control element and alternatively reads out information corresponding to the time based information stored in said second selected ones of said registers and represented by said second selected output on said same set of optical display elements in response to said second number of actuations of said single control element.

55. A timepiece according to claim 54 including:

means enabled by another of said operational states for altering the information stored in said selected ones of said registers in response to further manual actuations of said single control element within a second predetermined finite time period following said first predetermined finite time period.

56. A timepiece according to claim 54 wherein:

said single manually actuatable control element is a single manually operated switch having a single manually operated actuator and a single set of contacts.

57. An electronic timepiece comprising:

(a) a high frequency timing element;

(b) means driven by the timing element for producing signals representing time based information;

(c) a plurality of registers driven by said time based information signals for storing time based information represented thereby and for producing a plurality of outputs representative thereof;

(d) means for reading out said time based information stored in said registers to the user, said read out means including an input and comprised of optical display means having a set of optical display elements having the limited capability of displaying less than all of the time based information stored in said registers;

(e) a single control having only a single manually actuatable control element for effecting implementation of selected operational states each of which effects selective application of outputs representative of the time based information stored in selected ones of said registers to said input of said read out means;

(f) selection means responsive to manual actuations of said single control element for implementing selected ones of said plurality of operational states as a function of and in response to different numbers of said manual actuations of said single control element, said selection means implementing selected ones of said operational states only in response to said manual actuations of said single control element ocurring with a first predetermined finite time period;

(g) first means activated by a first selected one of said operational states implemented in response to a first number of said manual actuations of said single control element for applying outputs representative of the time based information stored in only first selected ones of said registers to said input of said read out means, said first selected ones of said registers being less than all of said registers; and (h) second means activated by a second selected one of said operational states implemented in response to a second number of said manual actuations of said single control element for applying outputs representative of the time based information stored in only second selected ones of said registers to said input of said read out means, said second selected ones of said registers being less than all of said registers;

whereby said read out means displays information corresponding to the outputs applied thereto representative of the time based information stored in said first selected ones of said registers on said set of display elements in response to said first number of actuations of said single control element and alternatively displays information corresponding to the outputs applied thereto representative of the time based information sotred in said second selected ones of said registers on said same set of display elements in response to said second number of actuations of said single control element.

58. A timepiece according to claim 57 including:

means enabled by another of said operational states for altering the information stored in said selected ones of said registers only in response to further manual actuations of said single control element occuring with a second predetermined time period following said selected first predetermined finite time period.

59. A timepiece according to claim 57 wherein:

said single manually actuatable control element is a single manually operated switch having a single manually operated actuator and a single set of contacts.

* * * * *